US008047988B2

(12) United States Patent
Lee et al.

(10) Patent No.: US 8,047,988 B2
(45) Date of Patent: Nov. 1, 2011

(54) AVATAR REFRIGERATOR

(75) Inventors: Ik-Kyu Lee, Changwon (KR); Soo-Beom Lee, Changwon (KR); Seung-Jin Oh, Changwon (KR); Sung-Ae Lee, Changwon (KR); Hee-Soo Son, Changwon (KR); Ki-Cheol Woo, Changwon (KR)

(73) Assignee: LG Electronics Inc., Seoul (KR)

( * ) Notice: Subject to any disclaimer, the term of this patent is extended or adjusted under 35 U.S.C. 154(b) by 674 days.

(21) Appl. No.: 11/910,421

(22) PCT Filed: Mar. 30, 2006

(86) PCT No.: PCT/KR2006/001179

§ 371 (c)(1), (2), (4) Date: Oct. 1, 2007

(87) PCT Pub. No.: WO2006/109944

PCT Pub. Date: Oct. 19, 2006

(65) Prior Publication Data

US 2008/0195944 A1 Aug. 14, 2008

(30) Foreign Application Priority Data

| | | |
|---|---|---|
| Mar. 30, 2005 | (KR) | 10-2005-0026470 |
| Jun. 21, 2005 | (KR) | 10-2005-0053589 |
| Jun. 21, 2005 | (KR) | 10-2005-0053590 |
| Jul. 1, 2005 | (KR) | 10-2005-0059347 |
| Jul. 6, 2005 | (KR) | 10-2005-0060648 |
| Jul. 6, 2005 | (KR) | 10-2005-0060649 |
| Jul. 18, 2005 | (KR) | 10-2005-0064891 |
| Jul. 18, 2005 | (KR) | 10-2005-0064893 |
| Jul. 18, 2005 | (KR) | 10-2005-0064895 |
| Jul. 30, 2005 | (KR) | 10-2005-0070062 |
| Oct. 5, 2005 | (KR) | 10-2005-0093521 |

(51) Int. Cl.

| | |
|---|---|
| ***G06F 3/14*** | (2006.01) |
| ***G06F 3/17*** | (2006.01) |
| ***G06F 3/00*** | (2006.01) |
| ***G06F 3/48*** | (2006.01) |

(52) U.S. Cl. ..... 600/300; 600/301; 715/757; 715/758; 348/208.15; 62/126; 62/127

(58) Field of Classification Search ..... 715/200–277; 700/701–799, 800–866; 709/201–229; 705/50–79; 713/300; 345/30–111; 235/385; 600/300, 600/301; 62/126, 127; 463/43

See application file for complete search history.

(56) References Cited

U.S. PATENT DOCUMENTS 6,934,862 B2 * 8/2005 Sharood et al. ..... 713/300

(Continued)

FOREIGN PATENT DOCUMENTS

| | | | |
|---|---|---|---|
| KR | 20-1998-0016091 | A | 6/1998 |
| KR | 10-0191499 | B1 | 1/1999 |
| KR | 2001-0003967 | A | 1/2001 |
| KR | 10-2004-0008961 | A | 1/2004 |
| KR | 10-2004-0017978 | A | 3/2004 |
| KR | 10-2001-0044443 | A | 1/2005 |

*Primary Examiner* — Ruay Ho

(74) *Attorney, Agent, or Firm* — Birch, Stewart, Kolasch & Birch, LLP

(57) ABSTRACT

The present invention relates to a refrigerator for providing a user with a variety of information using an avatar. The present invention comprises a storage device for storing avatar data including a figure and/or a motion of the avatar, a display device provided on an outer surface of the refrigerator to display the avatar, a control device for selecting the avatar to be displayed on the display device among the avatar data stored in the storage device and causing the display device to display the avatar, and an input device for receiving a command or information input from the outside. According to the present invention so configured, there is an advantage in that the display device can display a variety of avatars stored in the storage device in conformance with a condition.

46 Claims, 26 Drawing Sheets

U.S. PATENT DOCUMENTS

| | | | | |
|---|---|---|---|---|
| 7,077,751 | B2 * | 7/2006 | Nishiyama et al. | 463/43 |
| 7,386,799 | B1 * | 6/2008 | Clanton et al. | 715/758 |
| 2002/0000092 | A1 * | 1/2002 | Sharood et al. | 62/127 |
| 2003/0149344 | A1 * | 8/2003 | Nizan | 600/300 |
| 2005/0103029 | A1 * | 5/2005 | Kawahara et al. | 62/126 |
| 2005/0117024 | A1 * | 6/2005 | Lee | 348/208.15 |
| 2005/0228244 | A1 * | 10/2005 | Banet | 600/301 |
| 2007/0220907 | A1 * | 9/2007 | Ehlers | 62/126 |
| 2008/0116269 | A1 * | 5/2008 | Dearing et al. | 235/385 |

* cited by examiner

【Figure 1】
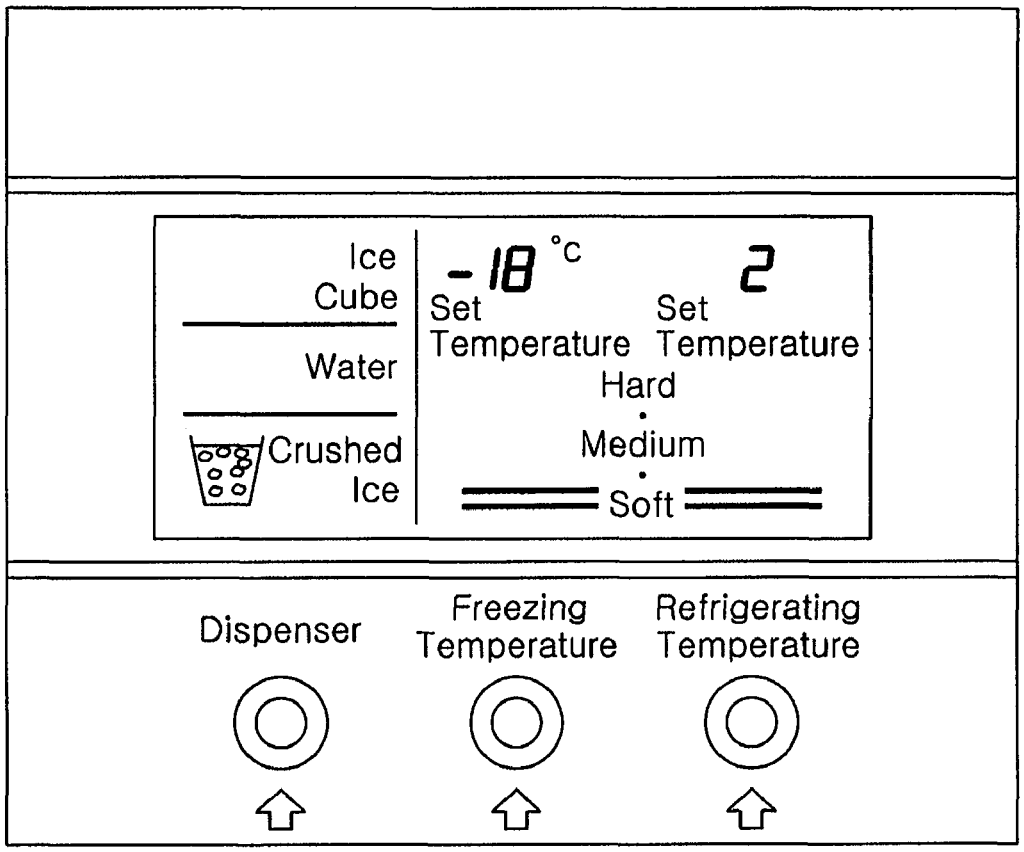

【Figure 2】
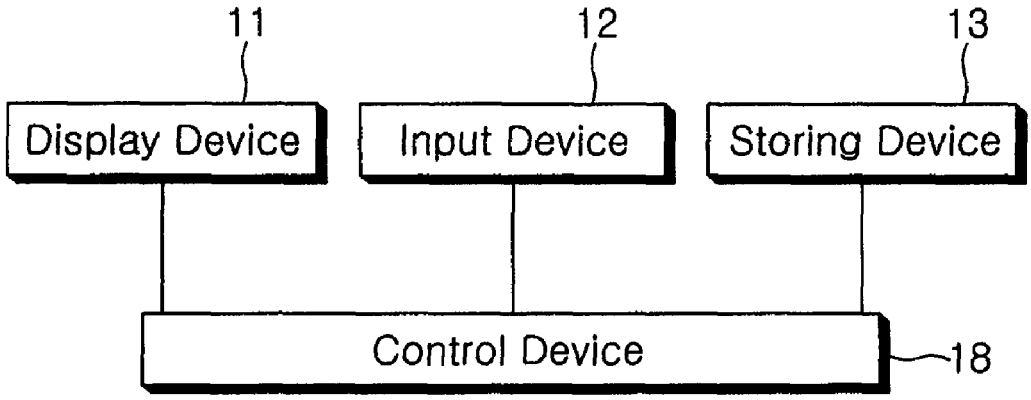

【Figure 3】
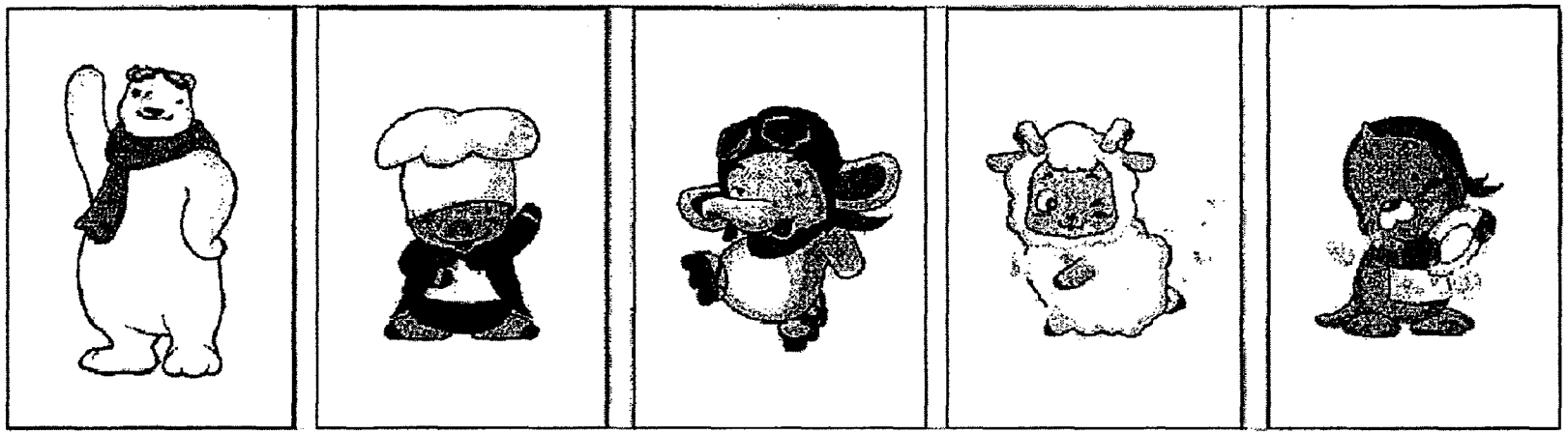

【Figure 4】
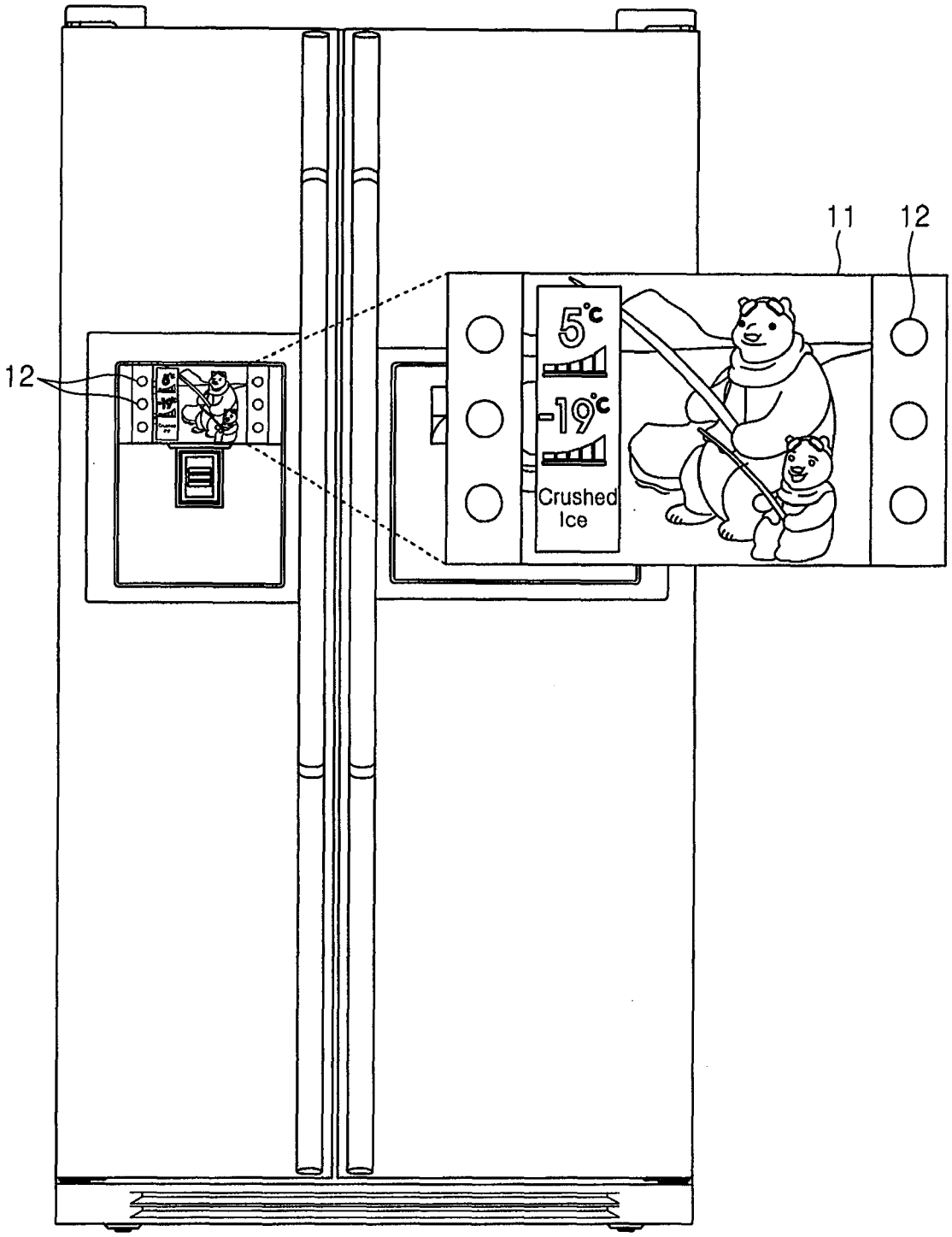

【Figure 5】
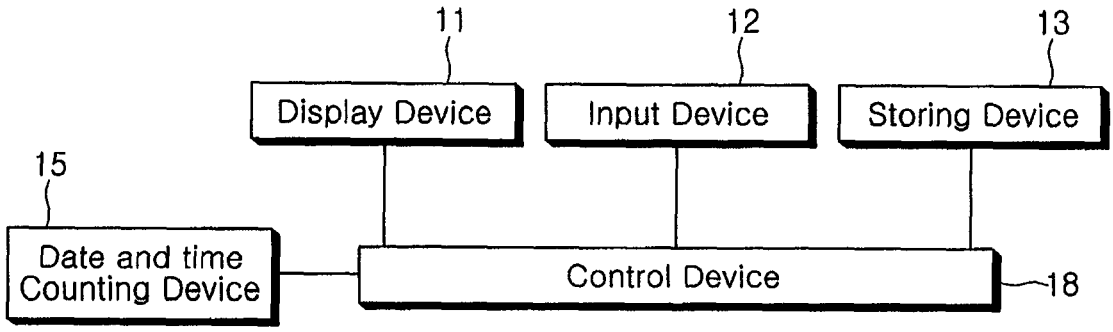
【Figure 6】
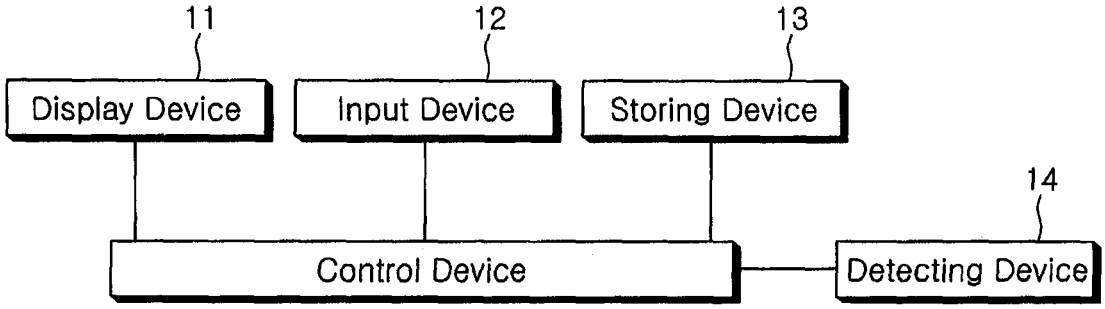

【Figure 7】
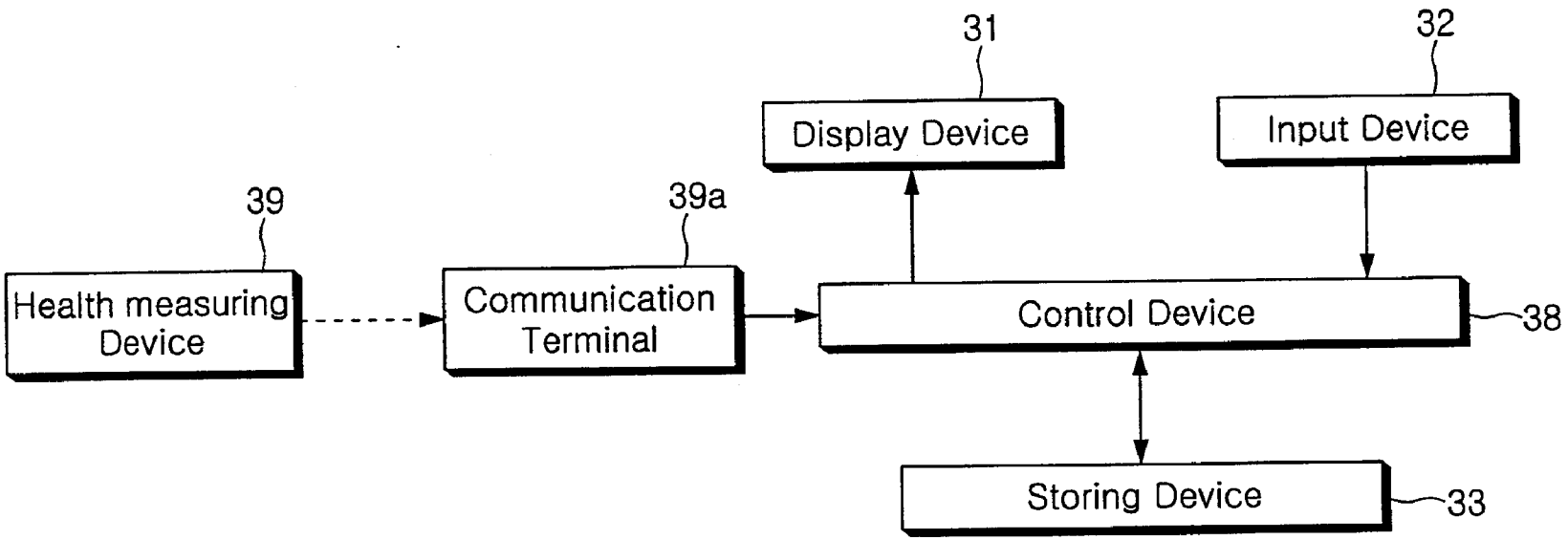

【Figure 8】
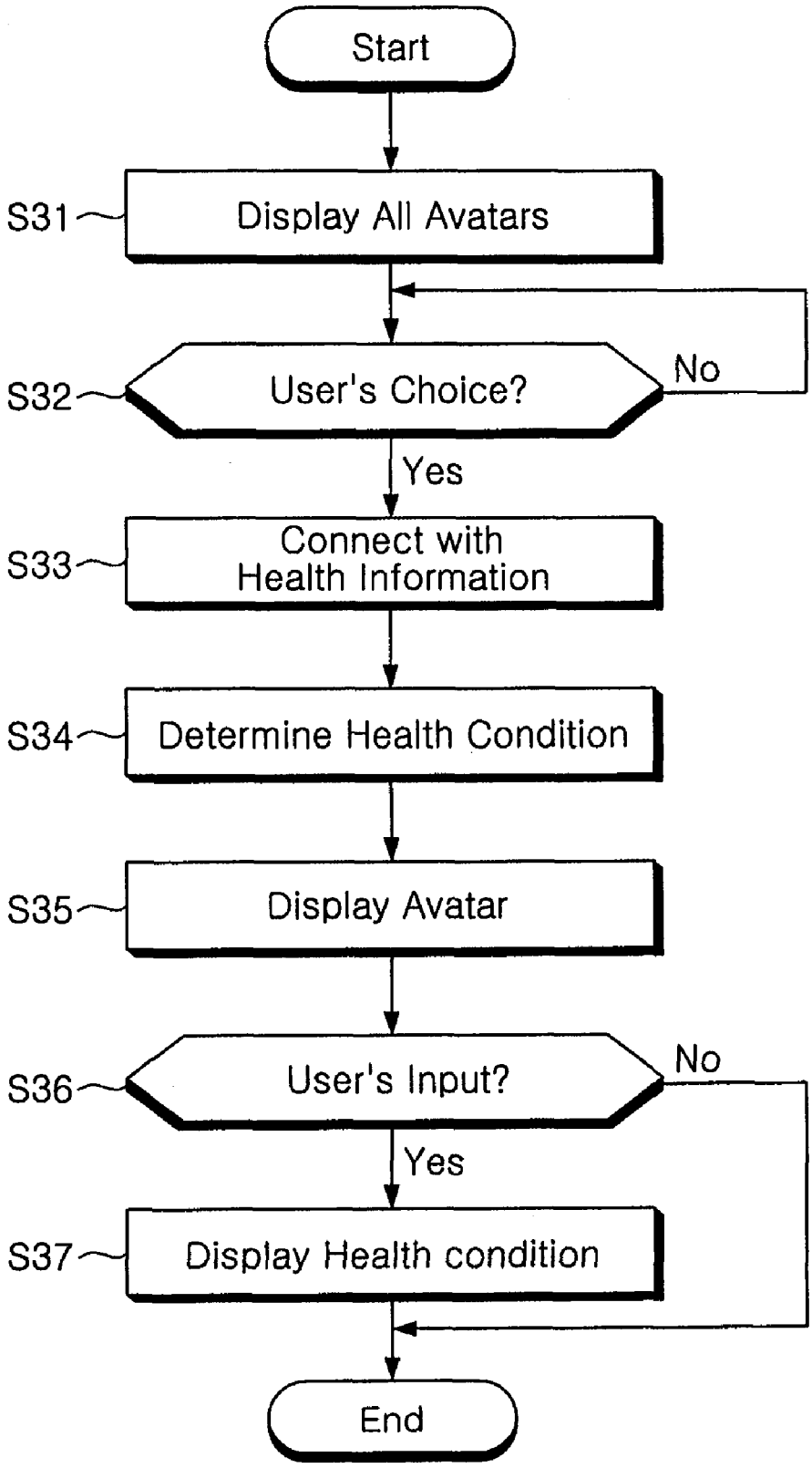

【Figure 9】
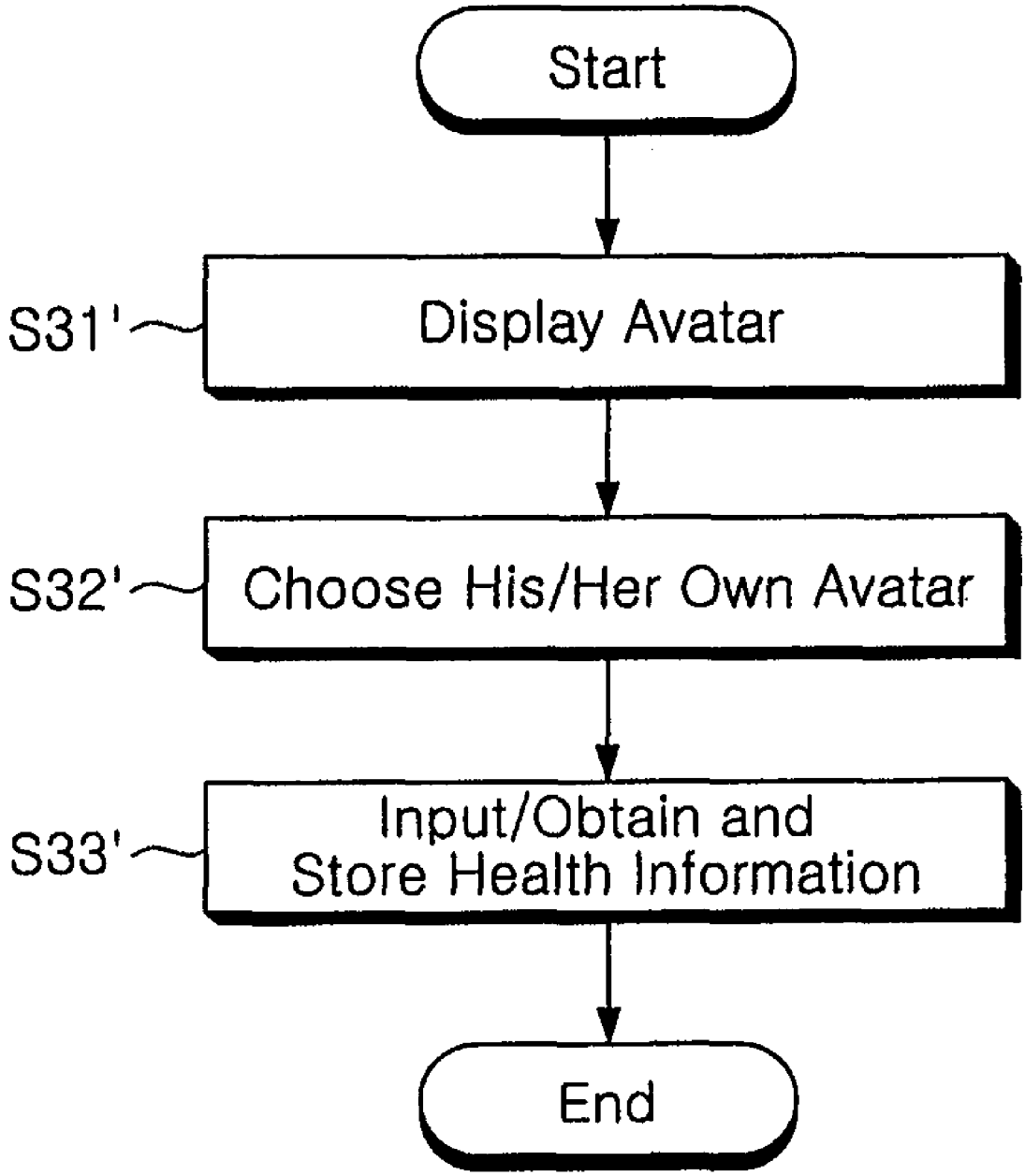

【Figure 10】
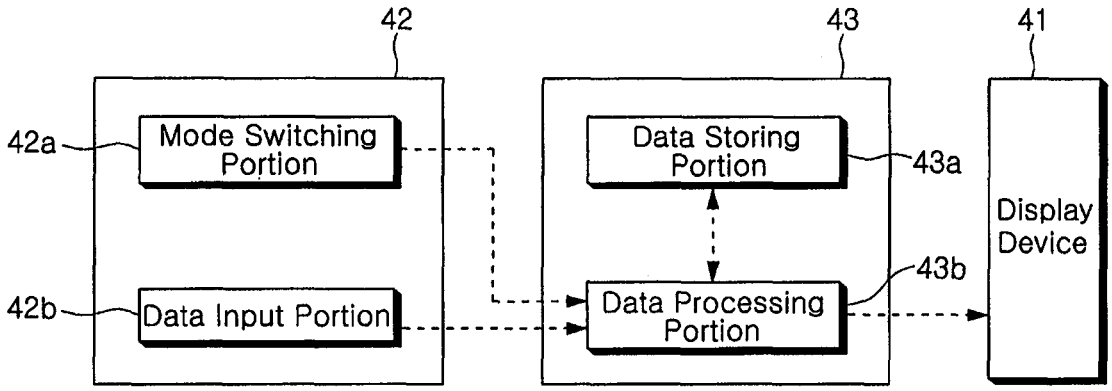
【Figure 11】
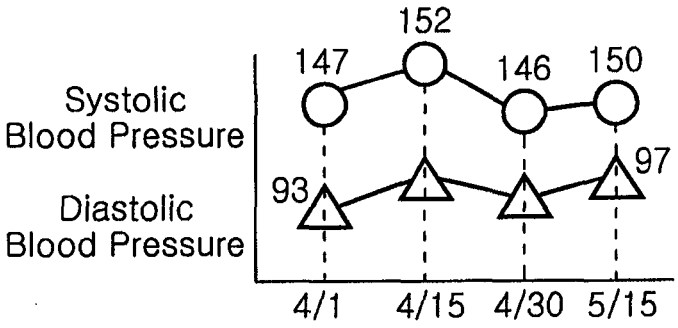

【Figure 12】
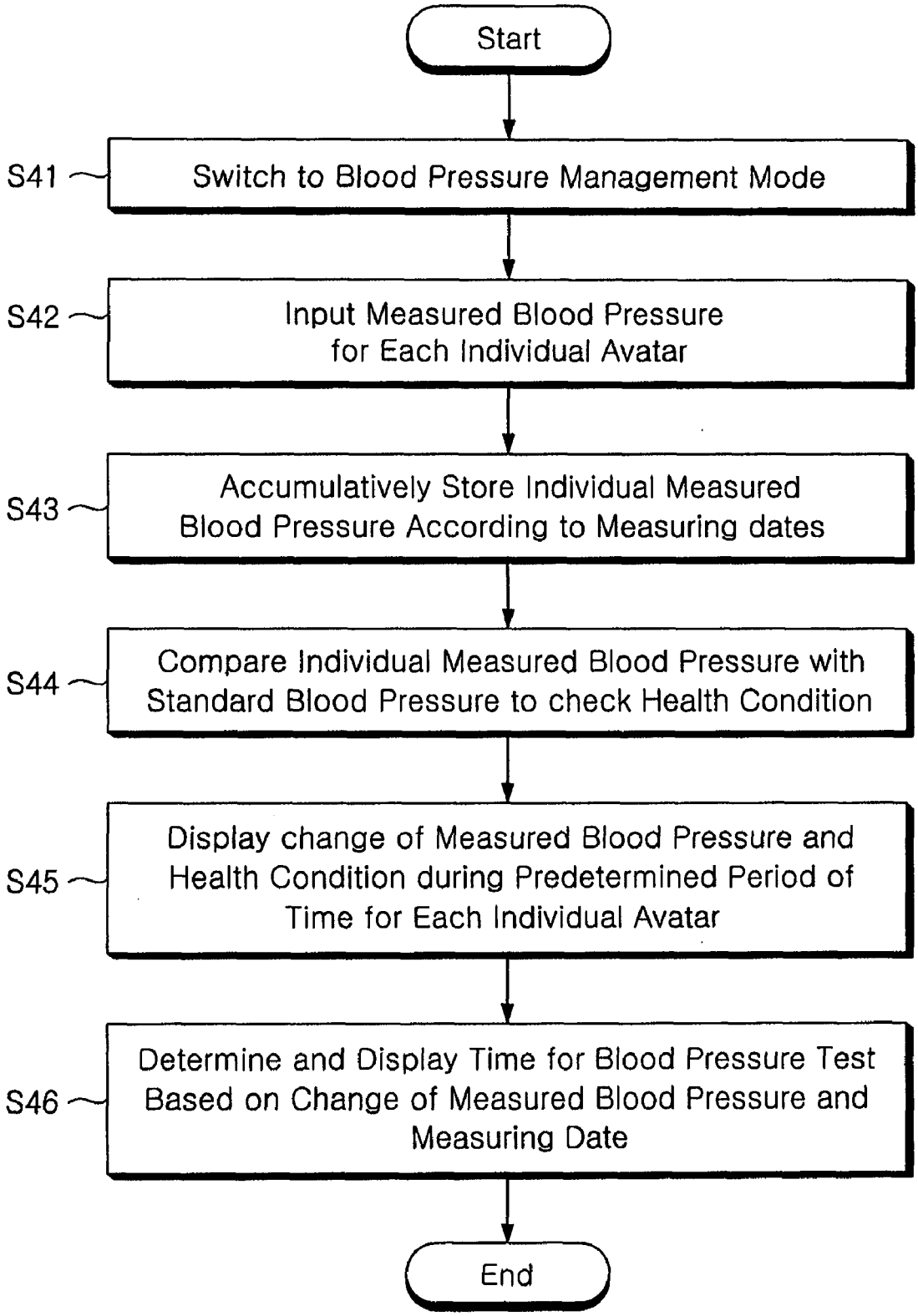

【Figure 13】
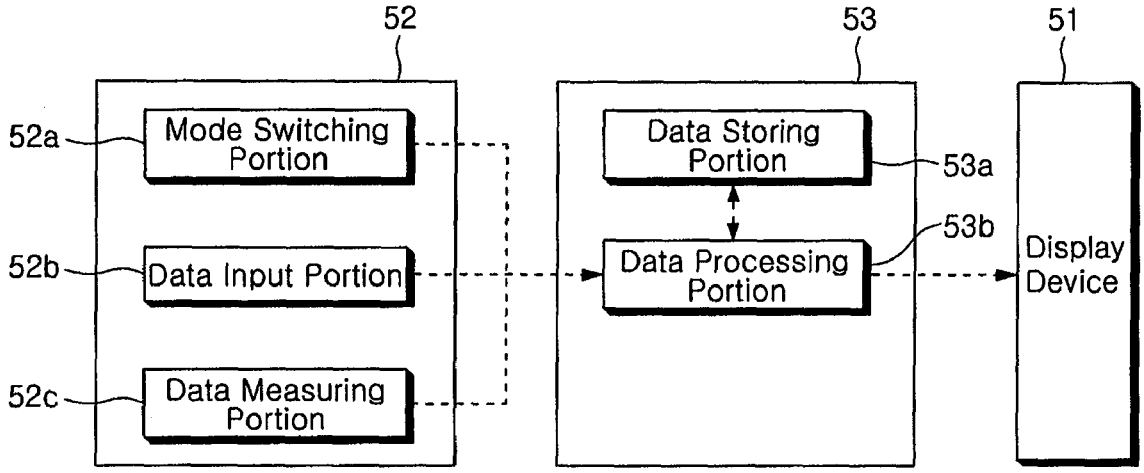

【Figure 14】
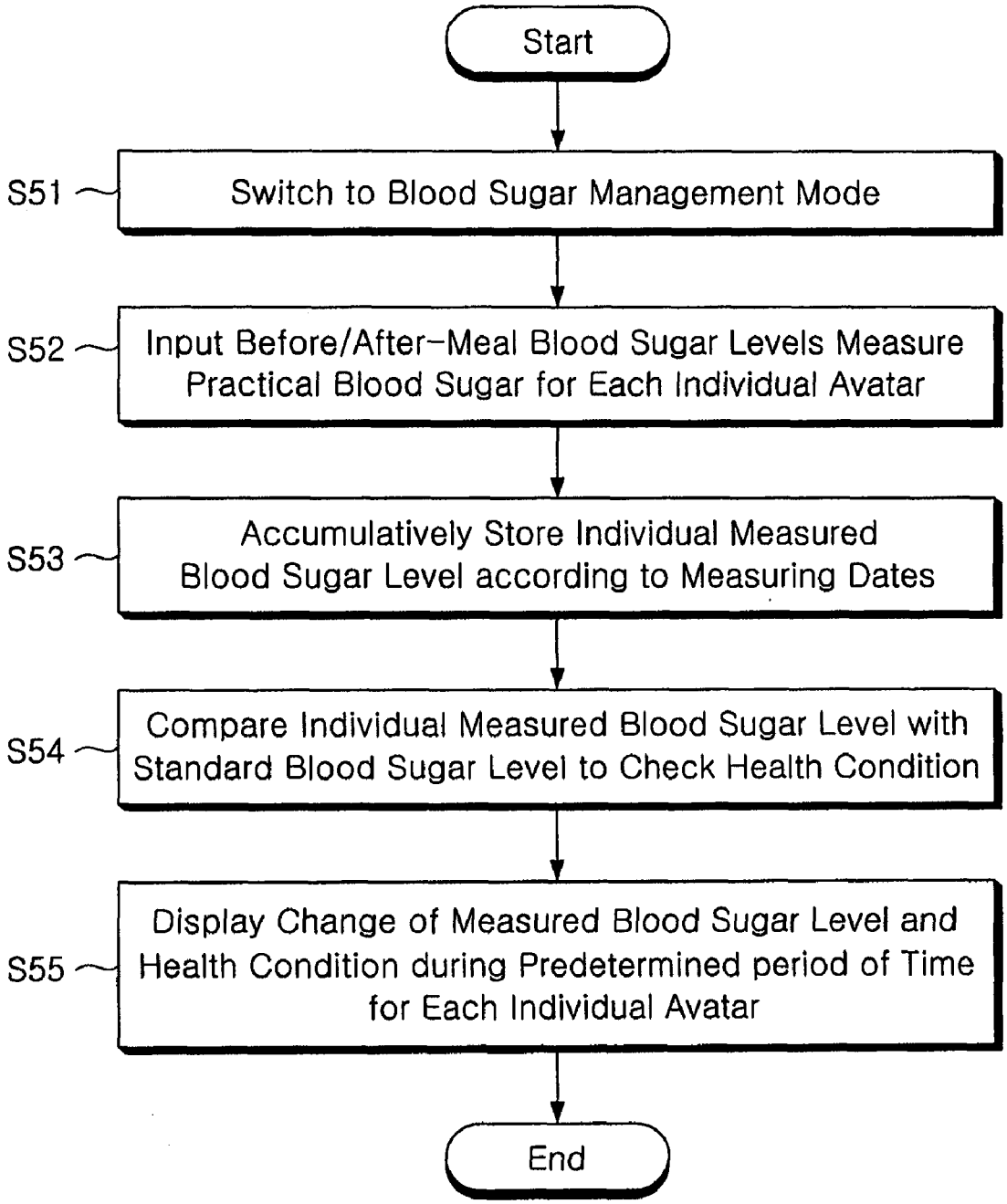

【Figure 15】
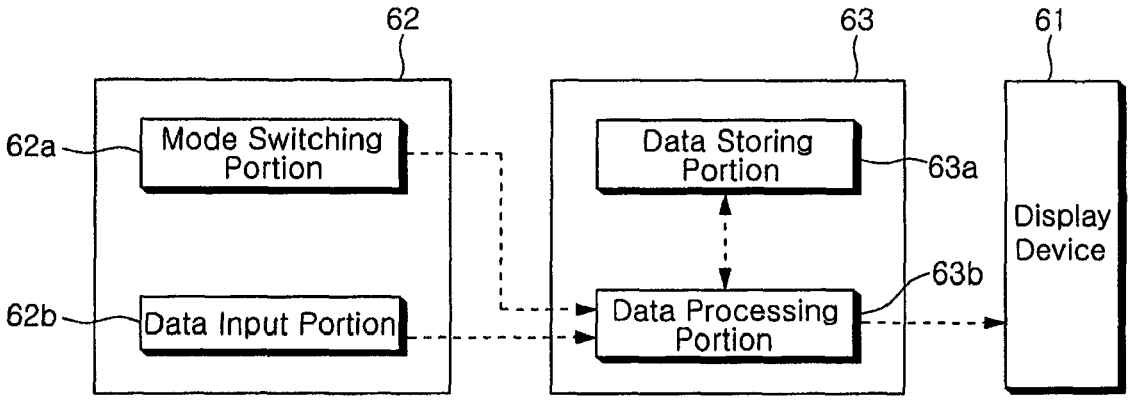

【Figure 16】
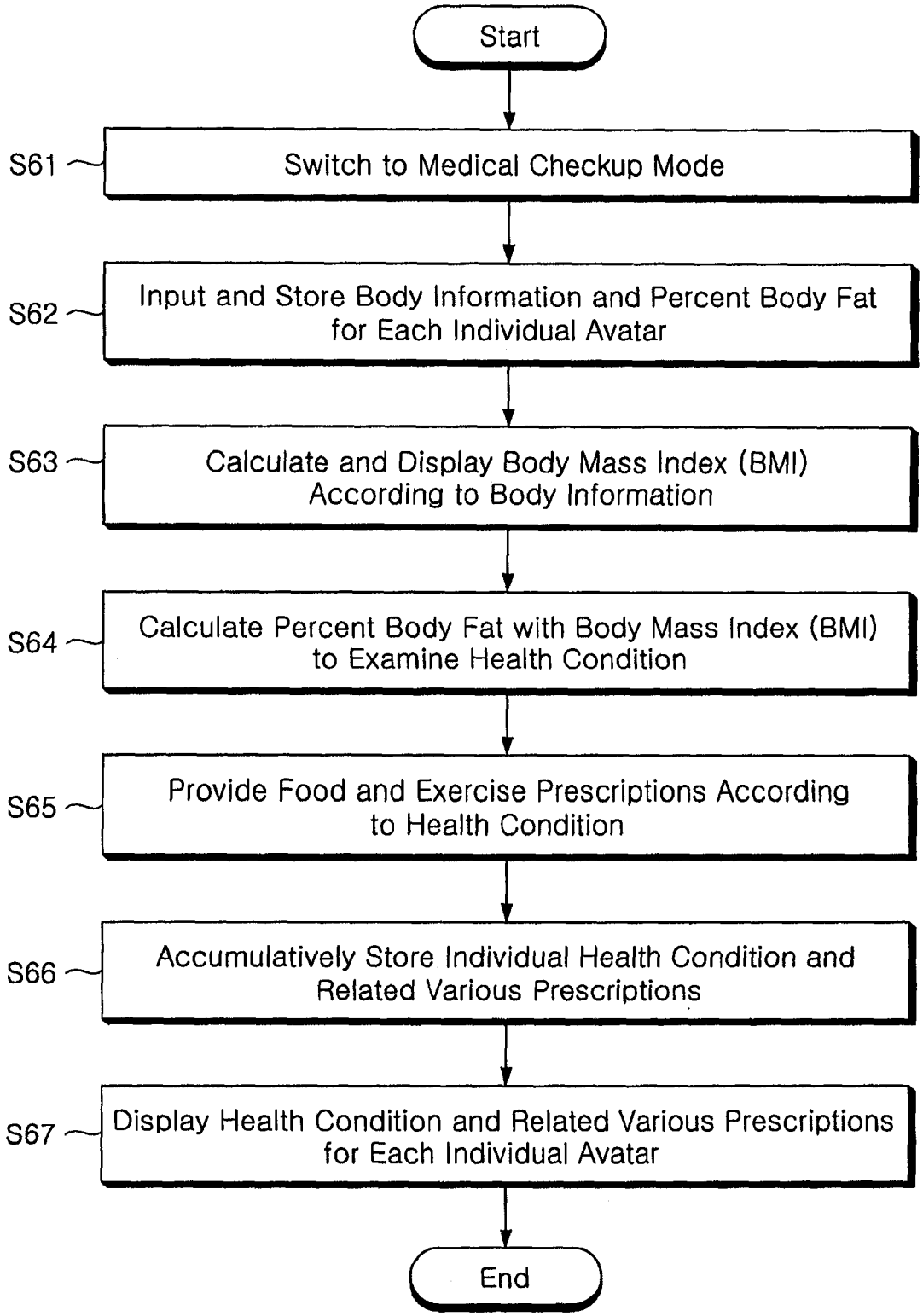

【Figure 17】
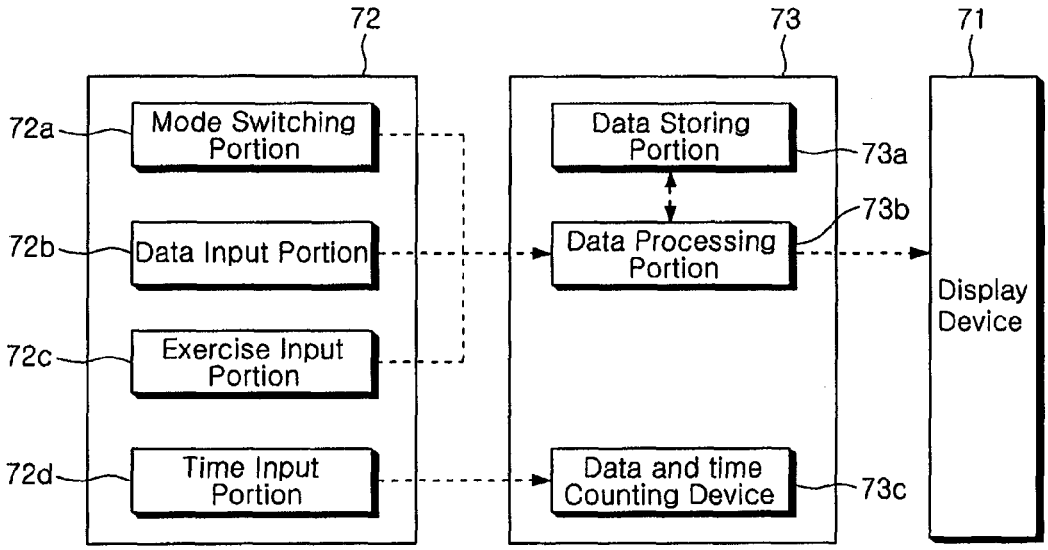

【Figure 18】
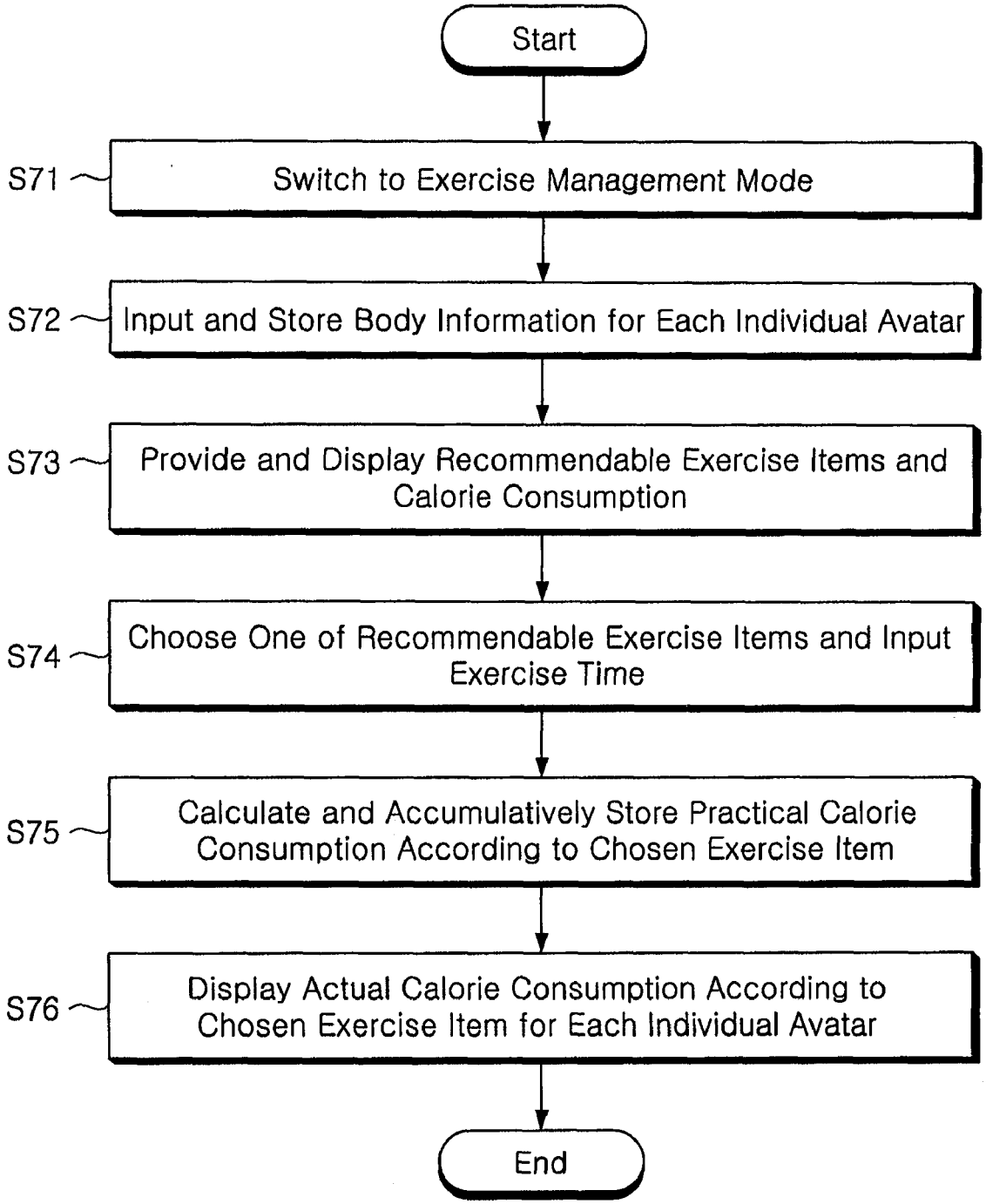

【Figure 19】
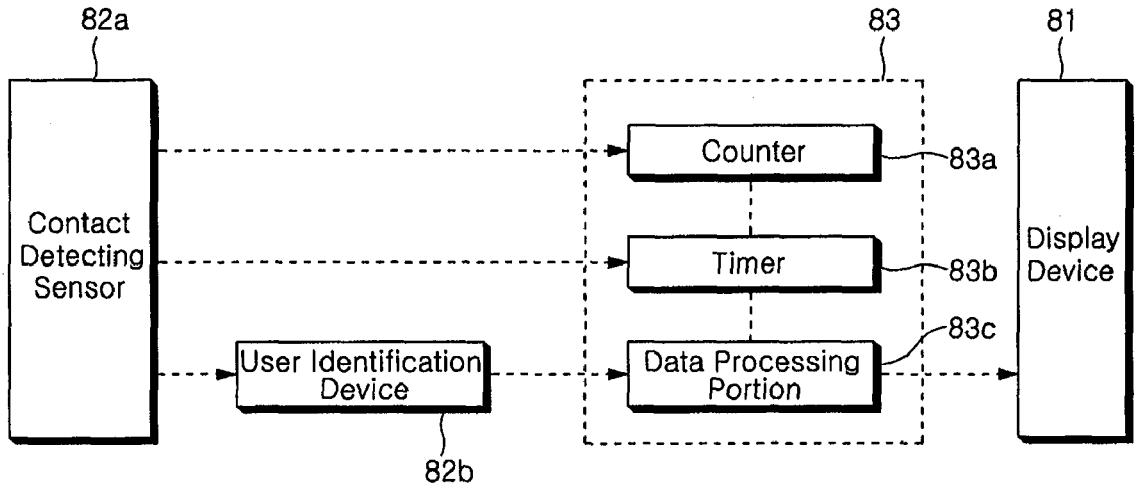

【Figure 20】
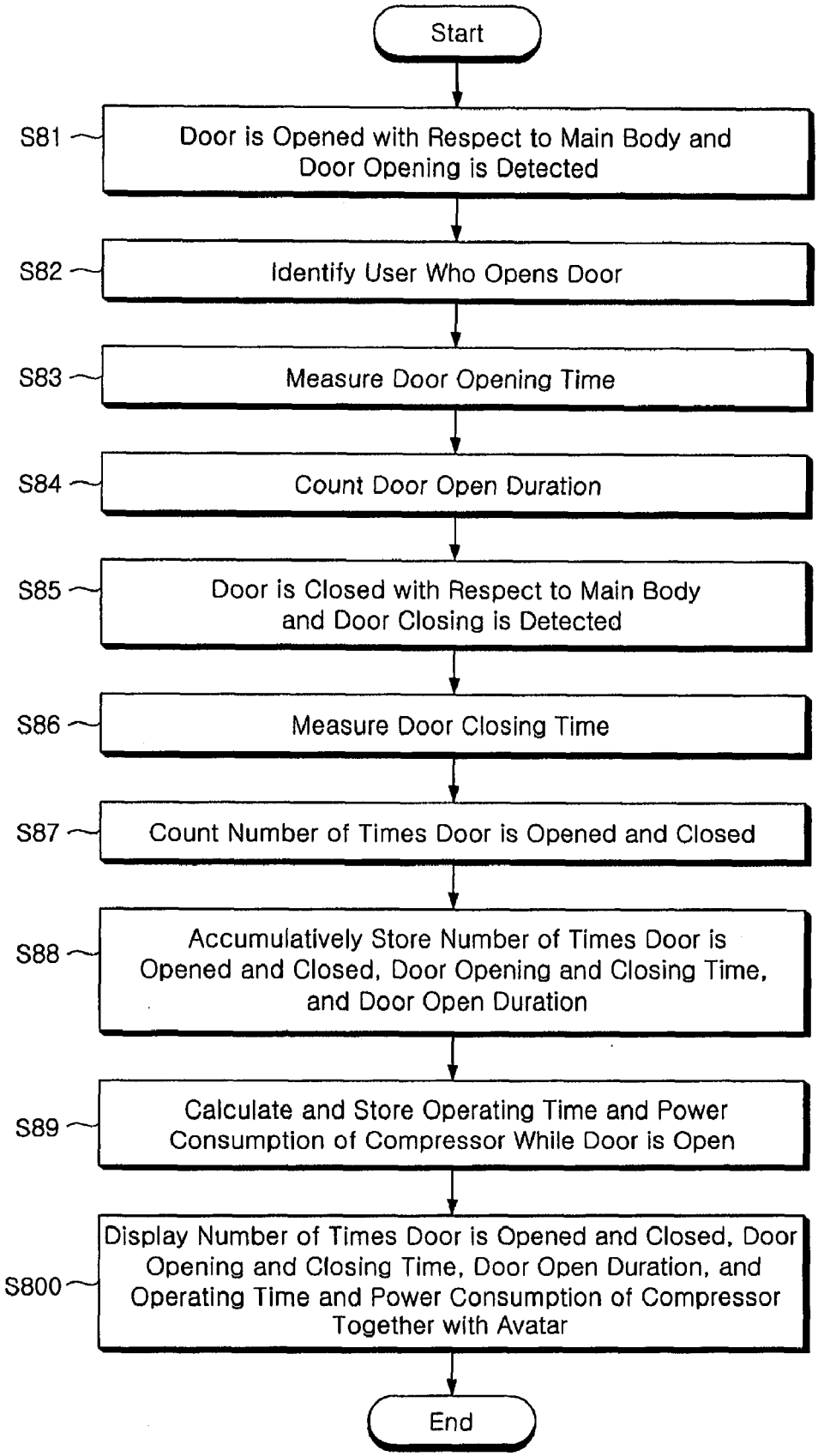

【Figure 21】
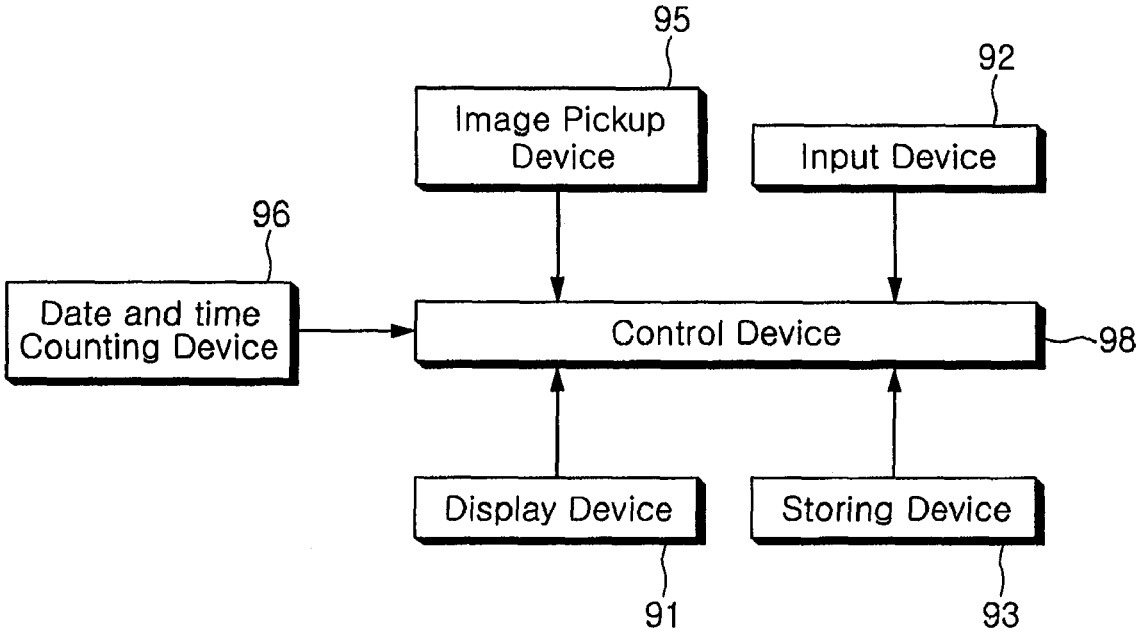

【Figure 22】
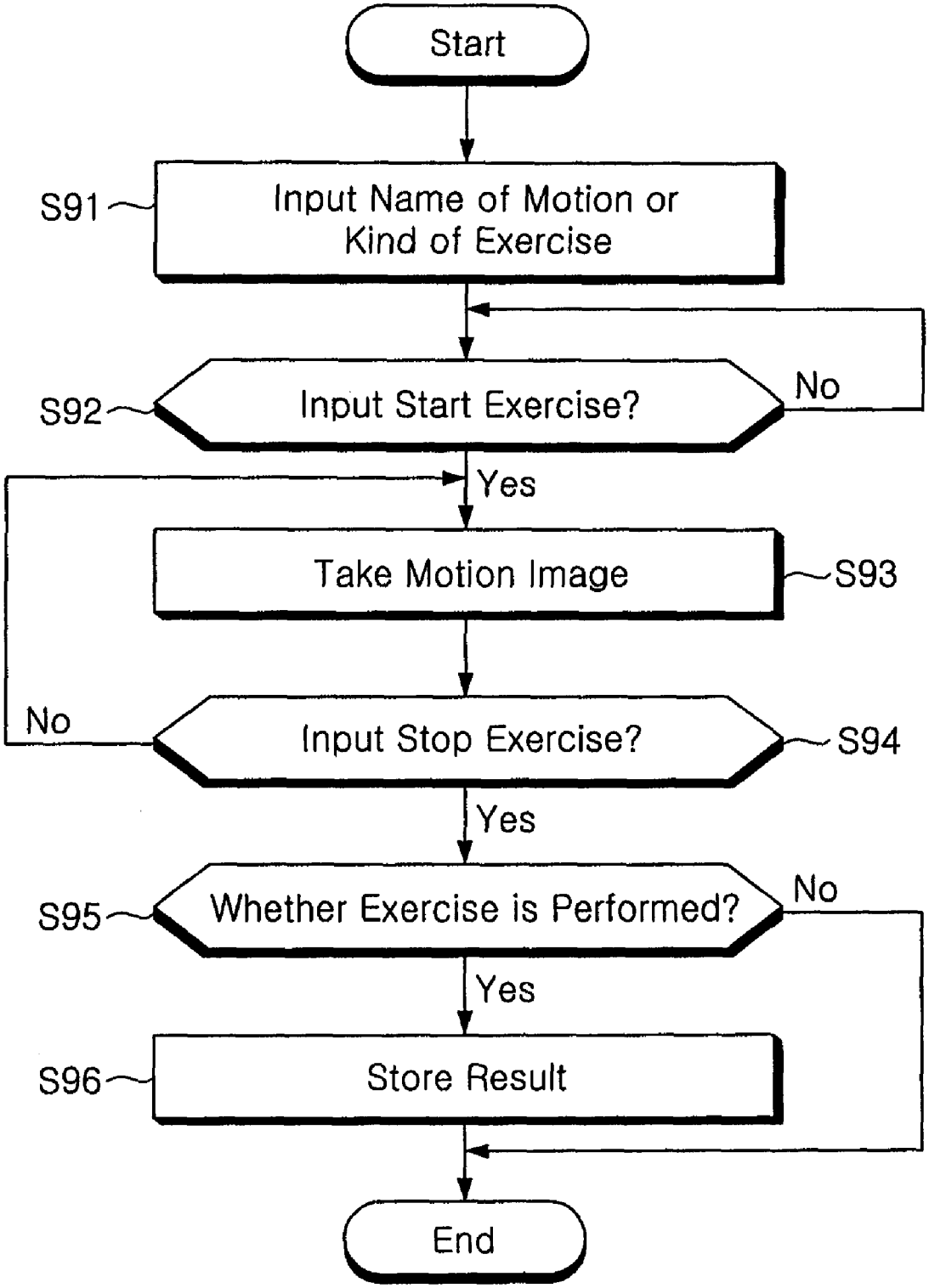

【Figure 23】
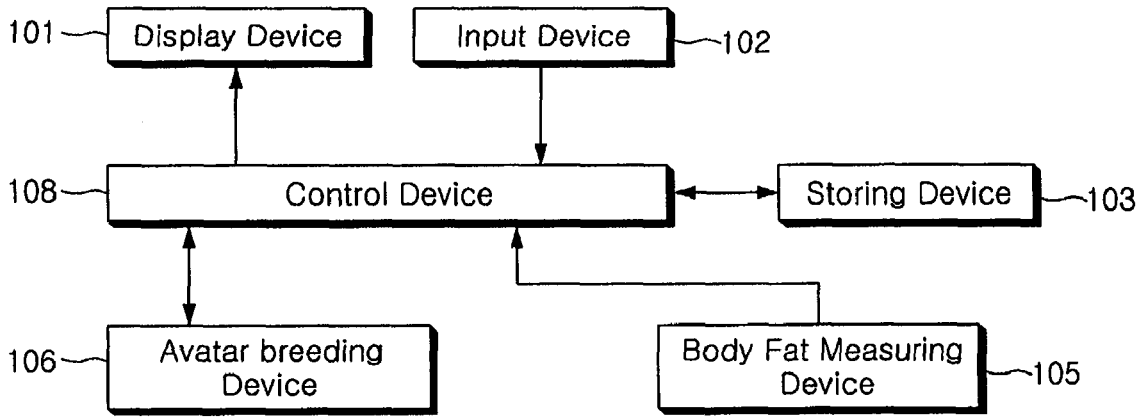

【Figure 24】
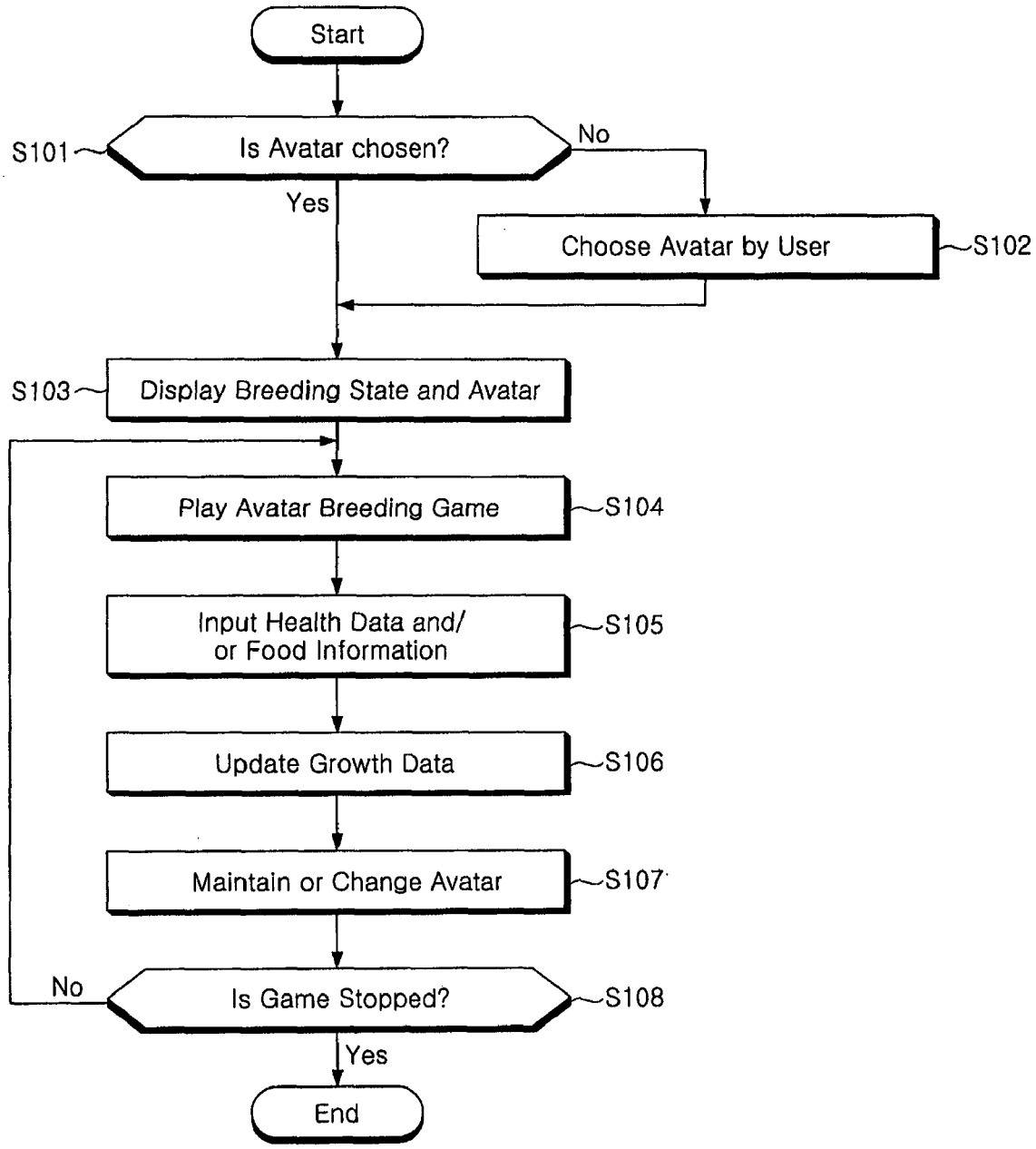

【Figure 25】
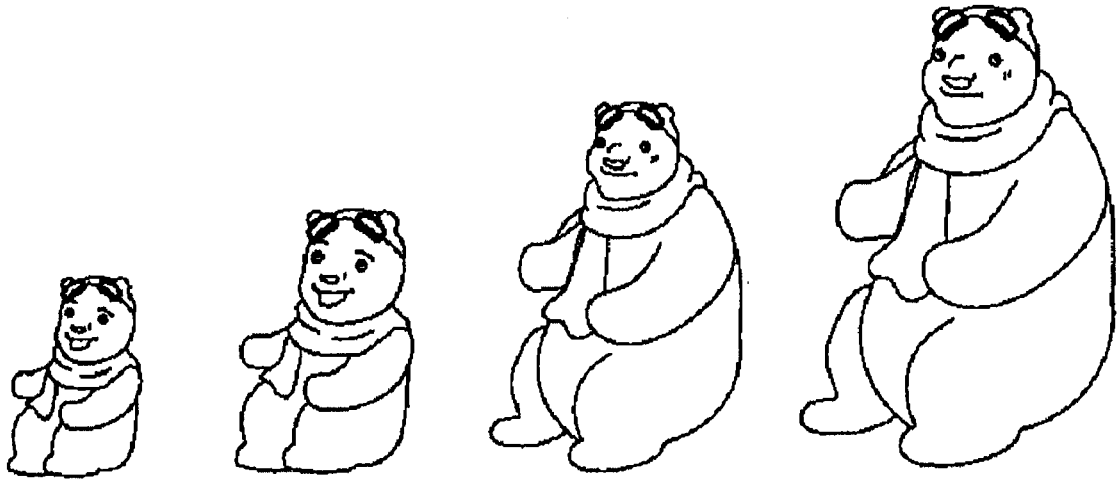

【Figure 26】
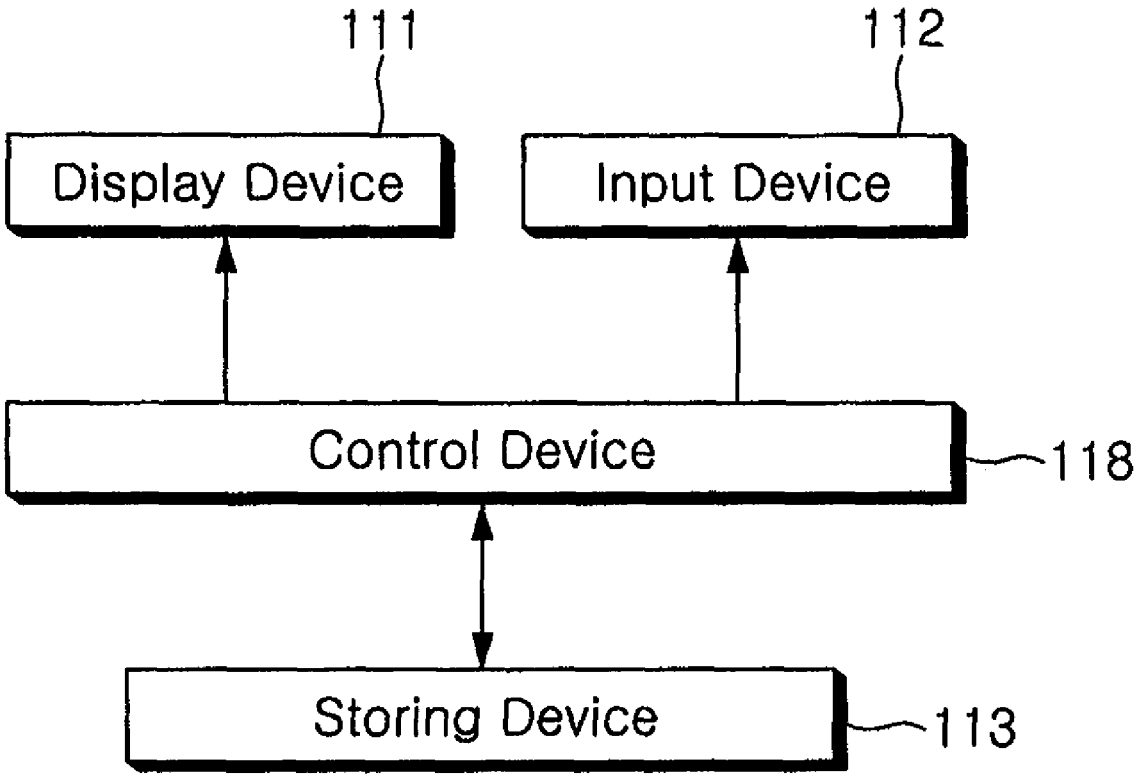

【Figure 27】
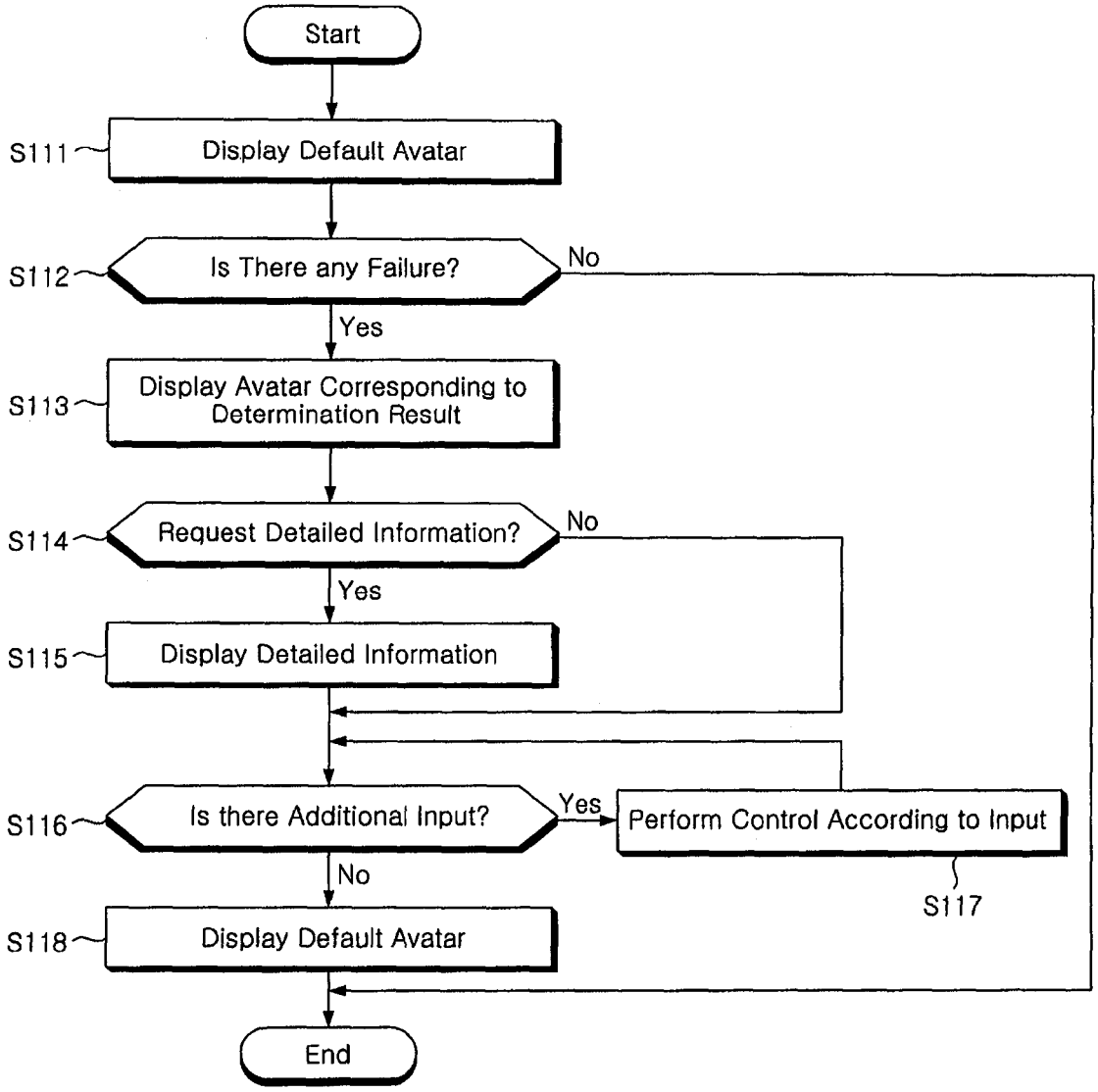

【Figure 28】
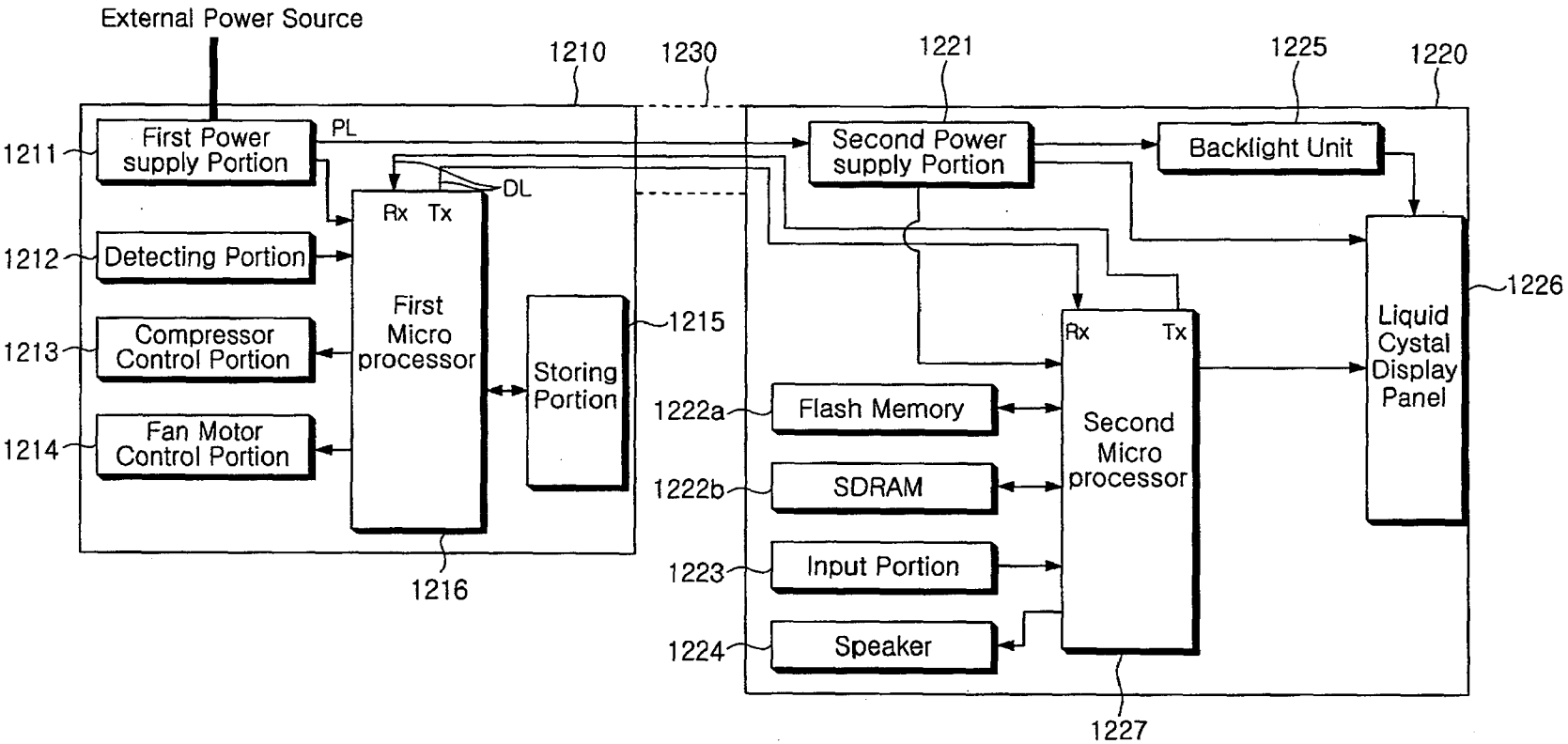

AVATAR REFRIGERATOR

TECHNICAL FIELD

The present invention relates to an avatar refrigerator for displaying an avatar on a refrigerator display device in accordance with previously set conditions of the avatar.

BACKGROUND ART

A conventional refrigerator includes a display portion such as a LCD panel, through which information on the refrigerator is displayed and the refrigerator is controlled. A user interface is displayed through such a display portion and shows the temperature in a refrigerating chamber, the temperature in a freezing chamber, a service type of a dispenser (water, crushed ice, and the like) in the form of numerals, letters and/or icons. There is provided an input portion such as buttons for controlling the temperatures of the refrigerating and freezing chambers and the services of the dispenser.

FIG. 1 is a view showing the configuration of a display portion of a refrigerator according to a prior art. As shown in the figure, a service type (ice cube, water and crushed ice) of a dispenser, the set temperature in a freezing chamber, and the set temperature in a refrigerating chamber are displayed on the display portion, and an input unit is provided at a lower end of the display portion.

However, the aforementioned prior art has the following problems.

That is, there is a problem in that the related art refrigerator cannot provide a user interface including desired background or characters and thus displays only simple information on the refrigerator.

Further, the related art refrigerator cannot display an avatar character with a variety of figures and/or motions in accordance with the state of the refrigerator or the current time. In addition, there is a problem in that the related art refrigerator cannot provide the refrigerator information using the figures and/or motions of the avatar character.

A display portion of the related art refrigerator cannot display desired background or characters. Further, the related art refrigerator cannot provide a game function that may cause the user's interest. Further, there is a problem in that the related art refrigerator cannot provide information on the health condition of a user and on the caloric intake of the user.

The related art refrigerator can neither determine the presence of the actual failure of the refrigerator nor provide the user with the information of the refrigerator failure. Further, since the refrigerator cannot provide the user with the information on the actual failure, the user should fully read the manual in the form of a book or inquire of a service center about the failure.

DISCLOSURE

Technical Problem

Accordingly, the present invention is conceived to solve the aforementioned problems in the prior art. An object of the present invention is to provide an avatar refrigerator for providing a user interface with desired background and characters.

Another object of the present invention is to provide an avatar refrigerator capable of displaying an avatar character with a variety of figures and/or motions in accordance with the refrigerator state and/or the current time.

A further object of the present invention is to provide an avatar refrigerator with an avatar growth game function.

A still further object of the present invention is to provide an avatar refrigerator capable of determining the presence of failure in the refrigerator and providing a user with the failure information.

Technical Solution

According to an aspect of the present invention for achieving the objects, there is provided an avatar refrigerator comprising a storage device for storing avatar data; a display device provided in the refrigerator for displaying the avatar data thereon; and a control device for allowing the avatar data to be displayed on the display device. At this time, the avatar data may include at least one of figure and motion of an avatar.

The avatar data further may include at least one of voice and letter information.

The control device may change at least one of the avatar data such that the avatar displayed on the display device can be changed.

The avatar refrigerator may further comprise an input device for receiving a command or information from the outside.

Preferably, the control device causes at least one avatar to be changed and displayed on the display device according to set information assigned to the avatar.

More preferably, the set information is stored or changed by means of the input device.

Still more preferably, the control device causes at least one avatar to be displayed on the display device according to the command input through the input device.

Still more preferably, the control device causes at least one avatar to be changed and displayed on the display device according to set information assigned to the avatar.

Here, the set information may cause the avatar to vary according to time.

Preferably, the avatar refrigerator further comprises a date and time counting device for calculating a current date and time, wherein the control device changes the avatar displayed on the display device according to the current date and time obtained from the date and time counting device.

More preferably, the avatar set information changes the avatar displayed on the display device according to a refrigerator state.

Here, the refrigerator state may include at least one of a temperature in a chamber, a door opening and closing state, a horizontal state of the refrigerator, and an operating state of a compressor.

Preferably, the avatar refrigerator further comprises a horizontal detecting portion for detecting the horizontal state of the refrigerator.

At this time, the control device may obtain a gradient from the horizontal detecting portion and causes the gradient to be displayed on the display device.

Preferably, the avatar set information includes information on a health condition, and the control device causes the avatar having the set information corresponding to the information on the health condition of a user to be displayed on the display device.

More preferably, the user's health condition information is stored or changed by means of the input device.

Still more preferably, the refrigerator is connected to a health measuring device for measuring the user's health condition, and the control device obtains the health condition information from a value measured from the health measuring device and stores the obtained health condition information into the storage device.

At this time, the control device may cause an abnormal region of a user's body to be displayed at a corresponding area on the avatar according to the health condition information.

Preferably, the portion of the avatar corresponding to the abnormal region of the user's body is changed in color or shape or flickers.

More preferably, the storage device stores standard health information, and the control device compares the user's health condition information with the standard health information to determine the user's health condition.

Still more preferably, the control device causes the user's health condition to be displayed on the display device in the form of letters when receiving the user's health condition from the input device.

Still more preferably, the storage device further includes predetermined treatment information, and the control device causes the treatment information corresponding to the user's health condition to be displayed on the display device.

Still more preferably, the control device stores separate avatar data for a plurality of avatars to allow an individual avatar to be chosen for each user and stores individual body information according to users.

Still more preferably, the input device includes at least one of an information input portion, a blood pressure measuring portion and a blood sugar measuring portion, and the control device causes the information input from the input device to be stored.

Still more preferably, the health condition information input through the information input portion includes at least one of blood pressure, a blood sugar, the body information, percent body fat.

Still more preferably, the input device includes a mode switching portion for switching a mode to a management mode in which the input information is shown, and a data input portion for allowing the individual avatar to en chosen among avatars displayed on the display device in the management mode switched by the mode switching portion and the individual health condition information to be input into the chosen avatar.

Still more preferably, the control device includes a data storing portion for accumulatively storing the individual health condition information input through the input device according to dates in the chosen individual avatar, and a data processing portion for causing a change in the health condition information stored in the data storing portion to be displayed on the display device.

Still more preferably, the data processing portion causes only the change in the health condition information for the last few days to be displayed on the display device.

Still more preferably, the data processing portion determines test time based on the change in the data according to dates and causes the determined test time to be displayed on the display device.

At this time, the blood sugar measuring portion may include a noninvasive blood sugar sensor capable of measuring a blood sugar level in a state where a body region is brought into contact with the sensor.

Preferably, the control device includes a data processing portion for comparing the individual health condition information input from the input device with the preset standard health condition information to manage a health condition or prescription, and a data storing portion for accumulatively storing the individual health condition information input from the input device and the individual health condition or prescription managed in the data processing portion together with a measuring date for each individual avatar.

More preferably, the data processing portion causes the individual health condition information accumulatively stored in the data storing portion and the health condition change or prescription to be displayed on the display device.

At this time, the body information may include at least one of sex, name, age, weight and stature. Preferably, the refrigerator provides recommendable exercise suitable to the input body information and corresponding calorie consumption, and the recommendable exercise and corresponding calorie consumption provided to the control device are displayed on the display device using the avatar.

An avatar refrigerator of the present invention comprises a detecting sensor for detecting whether a refrigerator door is opened or closed; a control device for counting and storing the number of times the door is opened and closed according to whether the door is opened or closed, which is detected by the detecting sensor; and a display device for causing the number of times counted in the control device together with the avatar to be displayed thereon.

Preferably, the control device causes at least one of the number of times respective freezing and refrigerating chamber doors are opened and closed, opening and closing time of the respective freezing and refrigerating chamber doors, a compressor operating time and power consumption during the compressor operating time.

At this time, the avatar refrigerator may further comprise a user identification device for identifying a user who opens the door, wherein the control device sets the avatar according to the user identified from the user identification device, accumulatively stores the number of times a relevant user has opened the door in the avatar for each user, and causes the number of times and the avatar for each user to be displayed on the display device.

Preferably, the avatar refrigerator further comprises an image pickup device for taking a motion image of a user.

More preferably, the storage device stores a plurality of avatar data different from each other according to growth degrees, growth data numerically represented according to the growth degrees of an avatar and user's health condition information; and the avatar refrigerator further comprises an avatar breeding device for updating the growth data according to the health condition information.

Still more preferably, the health condition information includes at least one of a user's body fat level and a calorie of food ingested by the user.

Still more preferably, the input device receives a growth period of time of the avatar, and the control device causes the avatar to grow for the growth period of time.

Still more preferably, the input device receives the health condition information from the user and the control device stores the health condition information in the storage device.

Still more preferably, the avatar refrigerator further comprises a measuring device for measuring the user's body fat level and providing the measured level to the control device, wherein the control device stores the body fat level as the health condition information in the storage device.

Still more preferably, the storage device stores calorie information of food, and the control device causes an image of the food to be displayed on the display device and receives information of the food chosen through the input device by the user to calculate the calorie of food ingested by the user.

Still more preferably, the storage device stores data on a breeding state where the avatar is bred, the display device displays the breeding state; the avatar breeding device updates the growth data according to a breeding command on the basis of the health condition information and the breeding state, and the control device receives the breeding command from the input device to transmit the breeding state data, the growth data and the health condition information to the avatar breeding device and to receives the updated growth data from the avatar breeding device.

Still more preferably, the control device determines whether the refrigerator is out of order or operates erroneously, and causes an avatar selected in accordance with the determination or a message indicating a determination result to be displayed on the display device.

Still more preferably, the avatar refrigerator further comprises an input device for allowing the user to input a request of detailed information on the determination result, wherein the storage device further stores the detailed information corresponding to the determination result and the control device causes the detailed information to be displayed on the display device at the request of the input device.

At this time, the storage device may store a control pattern of the refrigerator and the control device may compare a current operating state with the control pattern to determine whether the refrigerator is out of order.

Preferably, the display device comprises a power supply portion for receiving supplied power with predetermined voltage amplitude from the control device to generate a plurality of electric power; a display portion for receiving the supplied power or electric power to cause the avatar data and state and operating information of the refrigerator to be displayed thereon; a first storing portion for storing the avatar data and the state and operating information of the refrigerator; a second storing portion for temporarily storing the avatar data and the state and operating information of the refrigerator to transmit the data and information to the display portion; and a microprocessor supplied with the electric power for receiving the information data including the state and operating information of the refrigerator from the control device, storing the received information data in the first storing portion, reading the avatar data and the state and operating information of the refrigerator from the first storing portion to transmit and temporarily storing the data and information to and in the second storing portion, and reading the avatar data and the state and operating information of the refrigerator from the second storing portion to transmit the data and information to the display portion on which the data and information can be displayed.

At this time, the display portion may include any one of a liquid crystal display device, a light emitting diode and a plasma display device.

Preferably, the first storing portion is a flash memory and the second storing portion is an SDRAM. More preferably, the avatar refrigerator further comprises an input device for receiving an input command from the user, wherein the microprocessor transmits the information data including the input command to the control device.

At this time, the microprocessor causes at least one of the avatar character and the state and operating information of the refrigerator to be selectively displayed.

Preferably, the microprocessor reads the information data to cause the data to be displayed on the avatar when receiving the information data.

More preferably, the display device further includes a speaker portion for generating a sound.

Advantageous Effects

According to an avatar refrigerator of the present invention as described above in detail, the following advantages can be expected.

That is, the present invention has an advantage of providing a user interface with desired background and characters.

Also, the present invention has an advantage of displaying an avatar character with a variety of figures and/or motions in accordance with a refrigerator state or the current time.

In addition, the present invention has an advantage of providing information on the current time and a refrigerator state using figures and/or motions of an avatar.

Further, according to the present invention, it is easy to individually check a health condition connected with fatness and present an appropriate prescription, in addition to an essential function of storing food and the like at low temperature. Thus, there is an advantage in that it is possible to promote user's health.

Furthermore, according to the present invention, it is easy to individually recommend appropriate exercise and provide the amount of practical calorie consumption, in addition to an essential function of storing food and the like at low temperature. Thus, there is an advantage in that continued health care can be done, thereby promoting user's health.

Still furthermore, according to the present invention, there is an advantage in that whether a user takes exercise is determined by taking motions such as user's exercise in the form of a moving picture.

Still furthermore, the present invention has advantages of providing a user interface with desired background and characters and making a user to be more familiar with an avatar refrigerator.

Still furthermore, the present invention has an advantage of providing a game function.

Still furthermore, there is an advantage in that the present invention rapidly determines the presence of failure of the refrigerator and provides a user with the failure information, thereby allowing the user promptly to recognize the failure and take measures thereon.

DESCRIPTION OF DRAWINGS

FIG. 1 is a view of the configuration of a display portion of a related art refrigerator;

FIG. 2 is a block diagram showing a preferred embodiment of the present invention;

FIG. 3 is an exemplary view showing various kinds of avatars;

FIG. 4 is a front view showing an avatar refrigerator according to the present invention;

FIG. 5 is a block diagram showing a first embodiment of the present invention;

FIG. 6 is a block diagram showing a second embodiment of the present invention;

FIG. 7 is a block diagram showing a third embodiment of the present invention;

FIG. 8 is a flowchart of a service of displaying heath information performed in the avatar refrigerator according to the present invention;

FIG. 9 is a flowchart of inputting and obtaining heath information;

FIG. 10 is a block diagram showing a fourth embodiment of the present invention;

FIG. 11 is an exemplary view of a graph displayed on a display device;

FIG. 12 is a flowchart showing an operating state of the avatar refrigerator according to the present invention;

FIG. 13 is a block diagram showing a fifth embodiment of the present invention;

FIG. 14 is a flowchart showing an operating state of the avatar refrigerator according to the present invention;

FIG. 15 is a block diagram showing a sixth embodiment of the present invention;

FIG. 16 is a flowchart showing an operating state of the sixth embodiment of the present invention;

FIG. 17 is a block diagram showing a seventh embodiment of the present invention;

FIG. 18 is a flowchart showing an operating state of the seventh embodiment of the present invention;

FIG. 19 is a block diagram showing an eighth embodiment of the present invention;

FIG. 20 is a flowchart showing an operating state of an avatar refrigerator according to the eighth embodiment of the present invention;

FIG. 21 is a block diagram showing a ninth embodiment of the present invention;

FIG. 22 is a flowchart showing an operation order of the ninth embodiment of the present invention;

FIG. 23 is a block diagram showing a tenth embodiment of the present invention;

FIG. 24 is a flowchart of an avatar breeding game according to the tenth embodiment of the present invention;

FIG. 25 is an exemplary view of an avatar according to heath condition and/or food information;

FIG. 26 is a block diagram showing an eleventh embodiment of the present invention;

FIG. 27 is a flowchart of a service of displaying the presence of failure of the avatar refrigerator according to the present invention; and FIG. 28 is a block diagram showing a twelfth embodiment of the present invention.

BEST MODE

Hereinafter, preferred and other embodiments of an avatar refrigerator according to the present invention as above will be described in detail with reference to the accompanying drawings.

FIG. 2 is a block diagram showing a preferred embodiment of the present invention, FIG. 3 is an exemplary view showing various kinds of avatars, and FIG. 4 is a front view showing an avatar refrigerator according to the present invention;

As shown in FIG. 2, an avatar refrigerator 10 according to the preferred embodiment of the present invention comprises a display device 11 for displaying a user interface, a storage device 13 for storing data of the user interface and a plurality of avatars and avatar set information, and a control device 18 for controlling the above constitutional elements, causing the display device 11 to display the user interface and the avatar, and changing and displaying figures and/or motions of the avatar after reading the avatar set information from the storage device 13.

Here, the storage device 13 contains the data including the user interface having a background of the display device 11, a menu for user's input and the like, the data including avatars with a variety of figures and/or motions, and the avatar set information including a standard for keeping or changing the figures and/or motions of the avatar displayed in the display device 11. The user interface may be a background on which the avatar is displayed. The user interface may additionally display the information on a refrigerator state together with or separately from the avatar.

Next, the control device 18, which includes at least one central processing unit (not shown), may be a device including the aforementioned storage device 13 or a device only including a processor of the central processing unit or the like. However, in order to describe the data stored in the storage device 13 in detail, the control device 18 and the storage device 13 will be described as different elements from each other in the specification.

In addition, after reading the data of the avatar and/or the user interface stored in the storage device 13, the control device 18 makes them be displayed on the display device 11.

In the meantime, the preferred embodiment of the present invention may further include an input device 12 through which the commands connected with refrigerator control and avatar services are received.

The input device 12 is configured to have functions of inputting or changing and deleting the avatar set information connected with the display and/or change of the avatar as well as a unit for controlling a general refrigerator operation. However, the input device 12 comprises appropriate numbers of buttons or a touch pad in connection with the user interface and the like displayed through the display device 11. That is, the user interface may be configured in the form of various menus and the user can process the avatar set information by selecting the above menus. Thus, a minimum number of the buttons may be provided. In the meantime, as shown in FIG. 4, the input device 12 is provided near the display device 11 in consideration of the user's convenience.

Hereinafter, the operation of the preferred embodiment of the present invention so configured will be described.

As shown in FIG. 4, the avatar refrigerator according to the preferred embodiment of the present invention causes the user interface or avatar stored in the storage device 13 to be displayed on the display device 11. At this time, the displayed user interface or avatar is assigned as a default. Alternatively, the control device 18 causes the user interface to be displayed on the display device 11 such that the user can choose an avatar, and the control device also cause the avatar chosen by the user through the input device 12 to be displayed on the display device 11. The change of the avatar by the user may be always performed. The control device 18 reflects the change in the avatar set information and causes the reflected information to be stored in the storage device 13.

In addition, the control device 18 makes it possible to change the figures and/or motions of the avatar according to the predetermined avatar set information as well as to display the default avatar or the avatar chosen by the user. To this end, the control device 18 provides the user interface used to change and set the avatar set information, and the input of the change and choice of the displayed avatar or the input of the change and choice of the figure or motion of the avatar character according to a predetermined condition is obtained from the input device 12 and stored in the storage device 13.

Mode for Invention

The kind, the motion pattern and the function of the avatar displayed on the avatar refrigerator according to the present invention may be changed in various ways. Thus, a variety of preferred embodiments (first to twelfth embodiments) will be mainly described.

A first embodiment of the present invention is fundamental to the preferred embodiment of the present invention, but is characterized in that the change of the figure and motion of the avatar is performed according to the current date and time.

FIG. 5 is a block diagram showing the first embodiment of the present invention.

To this end, as shown in FIG. 5, the first embodiment of the present invention further comprises a date and time counting device 15 for computing the current date and time in addition to the constitutions of the preferred embodiment of the present invention.

When there is a request from the control device 18, the date and time counting device 15, which is a device for computing the current year, month, day and/or time (hereinafter, the current date and time), provides the control device 18 with the year, month, day and/or time when the request is received.

The control device 18 generally receives the current date and time through the date and time counting device 15 and causes the received current date and time to be displayed on the display device 11. At this time, if there is a condition connected with the current date and time in the avatar set information and the condition is satisfied, the control device 18 reads out an avatar whose figure and/or motion have been changed from the current avatar according to the satisfied condition and causes the read avatar to be displayed on the display device 11. For example, if the current avatar wears on summer clothes and the condition is set to change the avatar to one connected with the fall season as of September, the control device 18 reads out the avatar wearing on fall clothes from the storage device 13 and causes the avatar to be displayed on the display device 11.

A second embodiment of the present invention is fundamental to the constitutions of the preferred embodiment of the present invention, but is characterized in that the change of the figure and motion of the avatar is performed according to a refrigerator state.

FIG. 6 is a block diagram showing the second embodiment of the present invention.

To this end, as shown in FIG. 6, the second embodiment of the present invention further comprises a plurality of detecting devices 14 for detecting a refrigerator state in addition to the constitutions of the preferred embodiment of the present invention.

The detecting devices 14 for detecting a refrigerator state comprise sensors for detecting temperatures of refrigerating and freezing chambers, sensors for detecting the opening and closing of doors such as a freezing chamber door, a refrigerating chamber door, a home-bar door and the like, and sensors for detecting a refrigerator horizontal state. The aforementioned detecting sensors are mounted at appropriate positions in order to perform their corresponding detecting functions, and the detecting devices 14 including the detecting sensors transmit detected values to the control device 18. Particularly, the sensors for detecting a refrigerator horizontal state is mounted when the refrigerator horizontal state has influence on the control of the refrigerator and particularly on performance of a compressor, and measures a gradient of the refrigerator and gives it to the control device 18.

Hereinafter, the operation of the second embodiment of the present invention will be described.

For example, if the condition of the refrigerator state is connected with the temperatures in the refrigerating and freezing chambers, the control device 18 may change the current avatar into sweating avatar when the chamber temperature received from the detecting devices 14 is higher than a predetermined temperature and change the current avatar into an avatar shivering with cold when the received chamber temperature is lower than a predetermined temperature.

In addition, if the condition of the refrigerator state is connected with the opening and closing of a door, the control device 18 receives the information on the door opening and closing from the detecting devices 14. When the door is open, the control device 18 changes the current avatar to an open door. Then, when the door is closed, the control device 18 instantaneously changes the avatar from the open door to a closed door and then changes the closed door into the original avatar again.

In the meantime, if the condition of the refrigerator state is connected with the refrigerator horizontal state, the control device 18 receives the horizontal state information (i.e., gradient) from the detecting devices 14. When the refrigerator is inclined at a predetermined angle or more, the control device 18 changes the current avatar to one with a body inclined. At this time, the control device 18 may cause the display device 11 to display the received horizontal state information (i.e., gradient) in the form of letters.

Further, if the condition of the refrigerator state is connected with the compressor operating state, the control device 18 may change the current avatar into an avatar taking hard exercise after obtaining the information on the compressor operating state from the freezing or refrigerating chamber.

A third embodiment of the present invention is fundamental to the preferred embodiment of the present invention, but is characterized in that the change of the figure and motion of the avatar is performed according to user's health condition.

To this end, in the third embodiment of the present invention, a storage device 33 further has functions of storing the user's health information, a standard health information and treatment information taken according to a health condition, in addition to the basic functions of the storage device 13 of the preferred embodiment.

In addition, a control device 38 further has functions of selecting an avatar according to the user's health condition and displaying the avatar on a display device 31, in addition to the functions of the control device 18 of the preferred embodiment.

Further, an input device 32 is configured to be appropriate for inputting the user's health condition.

In the meantime, the third embodiment of the present invention may further comprise a health measuring device 39 for checking the user's health condition. That is, the user's health condition may be input through the input device 32 or checked from the health measuring device 39 to be stored.

Hereinafter, the constitutions of the third embodiment of the present invention will be described in detail with reference to FIG. 7 showing a block diagram of the third embodiment.

The input device 32 receives from a user the commands such as the choice of an avatar, the choice of the user (or user's avatar), the request of health information, health condition information and/or treatment information, the service type of a dispenser, the setting of temperatures in the refrigerating and freezing chambers, and comprises appropriate numbers of buttons or a touch pad in connection with the user interface and the like displayed on the display device 31.

Further, the storage device 33 stores the avatar information including a plurality of avatars, the user's and standard health information, the information on the temperatures of the refrigerating and freezing chambers, the information on the service type of dispenser, and the like.

Here, the avatar information includes a plurality of avatars, and the avatar may be made in the form of an animation or a still or moving picture having various external appearances and/or motions for a single character. Here, the respective avatars are character data having various external appearances and the like for exhibiting the health condition. For example, in a case where an avatar is a bear and its liver is abnormal, the liver is shown on the abdomen of the bear. At this time, the liver may be indicated black or excessively large or flicker to attract user's attention. That is, in order to inform the user or other users of a health condition of a specified user by displaying it, in correspondence to an abnormal body region in the health condition, an external form of the avatar is displayed, and for example, the corresponding region of the avatar may be changed in color or shape or flickered. Here, the storage device 33 further contains text data for displaying the health condition simply in the form of letters.

In addition, the storage device 33 stores the user's health information. Here, the health information includes information on food which the user ingests for a predetermined time, information on exercise which the user takes for a predetermined time, information on disease which is diagnosed or checked by the user for a predetermined time, and the like. The information on the ingested food includes the calorie intake for a predetermined period of time, the calorie intake per day, the data compared with the standard calorie intake, the intake of dietary fiber, and the like.

Further, the exercise information includes the kind and period of time of exercise which the user takes for a predetermined time, the consumed calorie corresponding to an amount of the exercise taken for the predetermined time, the data compared with the amount of the standard exercise, and the like. Furthermore, the information on disease includes user's blood pressure level, blood sugar level, diagnosed disease, weight (normal, fatness, overweight, or the like), and liver function level, and the like.

In addition, the storage device 33 stores the standard health information which is a comparison standard of the aforementioned user's health information. The standard health information includes standard values for the user's health information and is used as standard data when the control device 38 assesses the user's health condition.

Furthermore, the storage device 33 stores treatment information in response to the health condition or health condition information understood in the control device 38. The treatment information includes necessary medical treatments, such as cautions when food is ingested and medical treatment.

As shown in FIG. 7, the avatar refrigerator according to the present invention is provided with a communication terminal 39*a* connected to the health measuring device 39 for obtaining the user's health condition.

Here, the health measuring device 39 may be connected to the communication terminal 39*a*, and the control device 38 receives the health information measured in the health measuring device 39 through the communication terminal 39*a* and stored the health information in the storage device 33.

Specifically, the communication terminal 39*a* is a USB port to which the health measuring device 39, a kind of an external electronic machine, is connected, and connects the health check device 39 and the control device 38 so as to transmit electric signals therebetween.

Here, it is preferred that the health measuring device 39 be a medical instrument for measuring blood pressure, body fat, and the like which is health information connected with diseases such as high blood pressure and hyperlipemia caused from fatness in order to prevent and manage the diseases. The health measuring device 39 can directly measure the blood pressure, the body fat, and the like and is additionally configured to be connected to a USB cable at a side. Hereinafter, a case where the health measuring device measures the blood pressure and the body fat will be described in detail based on the other preferred embodiments of the present invention.

The control device 38 determines whether the health measuring device 39 is connected to the communication terminal 39*a* and can receive the health information from the health measuring device 39 when the health measuring device 39 is connected to the communication terminal 39*a*.

FIG. 8 is a flowchart of a heath information display service performed in the avatar refrigerator according to the present invention.

In detail, in step S31, if a user chooses the heath information display service by the avatar through the input device 32, the control device 38 reads the avatar information from the storage device 33 and causes the display device 31 to display all of avatars contained in the avatar information.

In step S32, the control device 38 waits until the user chooses at least one avatar through the input device 32.

In step S33, the control device 38 causes the avatar chosen by the user to be correlated with previously stored health information. Here, the control device 38 causes the health information distinguished according to a user to be further displayed. If the health information is specified by the user's choice through the input device 32, the specified health information is correlated with the avatar and stored in the storage device 33. However, even when there is not user's health information, the control device 38 generates the health information of the current user (which has no data but will have data in the future) and connects it with the chosen avatar.

In step S34, the control device 38 reads the user's health information and the standard health information from the storage device 33, and then, analyzes and assesses user's health condition by determining the health information in accordance with the standard health information. The health condition information including the health condition also includes information on user's specified body region with abnormality, the degree of the abnormality, and the like.

In step S35, the control device 38 causes the display device 31 to display the avatar chosen by the user according to the health condition separately or together with another user's avatar.

Here, the control device 38 allows the body portion of the avatar corresponding to the abnormal region of the user's body to have a different color or shape or to flicker. In addition, the indication may be different from the other body portions of the avatar according to the degree of the abnormality of the user's body.

In step S36, the control device 38 waits for a predetermined time such that the user can input additional information through the input device 32 (the user can press the portion of the avatar differently indicated in step S35 or input the additional information). If there is an input, the process goes to step S37. Otherwise, the process stops.

In step S37, the control device 38 causes the display device 31 to display the health condition of the specified body region in detail in the form of letters and the like according to the user's input. At this time, the control device 38 can further provide the user with the treatment information on the abnormality of the specified body region by displaying it on the display device 31.

The aforementioned embodiment allows the user to choose an avatar at first, connects the chosen avatar and the user's health information with each other, and displays the avatar according to the user's health condition.

FIG. 9 is a flowchart of inputting and obtaining heath information.

First, in step S31', the control device 38 causes the display device 31 to display all of avatars stored in the storage device 33 or the user's avatar. At this time, the control device 38 may cause a plurality of the avatars to be displayed at the same or different size or displayed one by one to circulate.

In step S32', the control device 38 causes a user who wishes to input desired health information through the input device 32 to be able to select his or her avatar.

In step S33', the control device 38 causes the storage device 33 to store the health information obtained through the communication terminal 39*a* from the health measuring device 39 and/or the health information input by the user through the input device 32.

In the aforementioned embodiment, the order of step S32' and step S33' may be changed so that the health information is input and/or obtained to be stored and the stored health information may be stored in addition to the health information connected with the avatar chosen by the user.

A fourth embodiment of the present invention is fundamental to the preferred embodiment of the present invention, but is characterized in that the change of the figure and motion of the avatar is performed according to user's blood pressure condition.

To this end, in the fourth embodiment of the present invention, a control device 43 has functions of the storage device 13 and the control device 18 of the preferred embodiment and accumulatively stores blood pressure information input from an input device 42. Preferably, the control device 43 comprises a data storing portion 43*a* for accumulatively storing individual blood pressure levels input from the input device 42 in correspondence to the individual avatar according to dates, and a data processing portion 43*b* for causing the change of the blood pressure levels with respect to date stored in the data storing portion 43*a* to be displayed on a display device 41.

Further, the input device 42 preferably comprises a mode switching portion 42*a* for switching a temperature control mode for controlling temperatures of the freezing and refrigerating chambers to a blood pressure management mode for showing the change of the individual blood pressure levels, and a data input portion 42*b* for allowing the individual avatar out of the avatars displayed on the display device 41 to be chosen and allowing the individual blood pressure levels to be input according to date in the blood pressure management mode switched by the mode switching portion 42*a*.

FIG. 10 is a block diagram showing an avatar refrigerator according to the fourth embodiment of the present invention.

As shown in the figure, if the blood pressure levels are individually input through the input device 42, the control device 43 accumulatively stores the individual blood pressure levels and simultaneously causes the display device 41 to display the change of the individual blood pressure levels for a predetermined period in correspondence to the individual avatar.

At this time, the input device 42 is positioned on the upper front surface of the freezing chamber door.

In the meantime, the data input portion 42*b* is configured so that diastolic and systolic blood pressure levels are input to be classified by individuals in the blood pressure management mode. At this time, the refrigerator may be provided with a blood pressure measuring device so as to directly measure the blood pressure levels or a blood pressure measuring device is connected to the refrigerator to directly input the measured blood pressure levels through the data input portion 42*b*.

At this time, in any case where the data input portion 42*b* is configured so that the measured blood pressure levels are input in figures or the blood pressure levels are directly measured, in order for the user to easily use the data input portion 42*b*, it is preferred that the data input portion 42*b* be positioned adjacent to the mode switching portion 42*a* and on the front surface of the refrigerator door at a height within the reach of the user.

In addition, the control device 43 comprises the data storing portion 43*a* for accumulatively storing the measured blood pressure levels according to the dates in the blood pressure management mode, and the data processing portion 43*b* for causing a display device 41 to display the measured blood pressure levels stored in the data storing portion 43*a* for a predetermined period and accordingly the change of the health condition.

The data storing portion 43*a* may be configured to provide an appropriate menu and the art of cooking thereof according to the blood pressure levels so that a dietary treatment connected with high blood pressure is provided in addition to accumulatively storing the measured blood pressure levels according to the dates.

Particularly, the data processing portion 43*b* stores the measured blood pressure levels input from the data input portion 42*b* in the data storing portion 43*a* according to the relevant dates. It is preferred that the data processing portion 43*b* in itself recognize and accumulatively store the date when the measured blood pressure levels are input. Alternatively, the data processing portion 43*b* can be configured such that the date when the measured blood pressure levels are measured is optionally input by an additional input device 42.

As described above, the data processing portion 43*b* accumulatively stores the measured blood pressure levels in the data storing portion 43*a* according to the dates and simultaneously assesses the health condition by comparing the measured blood pressure levels with the standard blood pressure levels. Also, the data processing portion 43*b* causes the display device 41 to display the health condition together with the measured blood pressure levels in correspondence to the individual avatar. Particularly, the changes of the measured blood pressure levels and health condition for a predetermined period can be displayed on the display device 41 in correspondence to the individual avatar.

In the meantime, since the capacity of the data storing portion 43*a* is limited, it is preferred that the data processing portion 43*b* automatically deletes the measured blood pressure data which were measured before a predetermined period of time or over the predetermined number of times from the data storing portion 43*a*. (→ 의미 전달이 제대로 되었는지 확인 바랍니다) The health condition can be determined by checking the change of the blood pressure levels for the predetermined period of time or within the predetermined number of times.

For example, the standard systolic blood pressure level in a range of 140-100 mmHg and the standard diastolic blood pressure level in a range of 90-70 mmHg are stored in the data storing portion 43*a*. In addition, the data processing portion 43*b* determines the health condition on the basis of the standard systolic and diastolic blood pressure ranges. Specifically, it is determined that the user is normal if the blood pressure levels are in the standard systolic and diastolic blood pressure ranges, suffers high blood pressure if the blood pressure levels are larger than the standard systolic and diastolic blood pressure ranges, and suffers low blood pressure if the blood pressure levels are lower than the standard systolic blood pressure ranges.

Further, the data processing portion 43*b* may check the health condition and simultaneously provide a dietary treatment appropriate thereto in consideration of the measured blood pressure levels or the changes thereof. To this end, after separately receiving user's body information such as sex, age, and weight, in consideration of caloric intake and nutrients necessary per day on the basis of the body information, it is possible to make a recommendable menu and cause the display device 41 to display it.

It is preferred that the menu is made so that the given total calorie is taken in balance from three main nutrients of carbohydrate, protein, and fat, vitamins, minerals, and the like are not lacked, and intake of salts is limited when the user suffers high blood pressure.

In the meantime, the operation of the display device 41 is controlled by the data processing portion 43*b*. Particularly, the measured blood pressure levels are received in correspondence to the individual avatar in the blood pressure management mode, and the change of the measured blood pressure levels for a predetermined period, the change of the health condition according thereto, the recommendable menu, and the like are displayed in various forms of graphs, letters, pictures, sounds, or the like.

For example, as shown in FIG. 11, the systolic and diastolic blood pressure levels are displayed according to measuring dates, so that it is possible to easily understand the changes of systolic and diastolic blood pressure levels.

FIG. 12 is a flowchart showing an operating state of the avatar refrigerator according to the present invention.

First, in steps S41 and S42, when a mode is switched into the blood pressure management mode, the measured blood pressure levels are input in correspondence to the individual avatar (see steps S41 and S42).

At this time, when the user presses the mode switching portion 42*a* to switch the temperature control mode to the blood pressure management mode, the display device 41 displays a variety of avatars, and the user chooses one of a variety of the avatars through the data input portion 42*b*. Then, if the user directly input the measured blood pressure levels in figures through the data input portion 42*b*, the measured blood pressure levels are stored in correspondence to the individual avatar.

In the meantime, in a case where the blood pressure levels are directly measured in the data input portion 42*b*, even if the mode switching portion 42*a* is not pressed, the blood pressure levels are automatically stored after directly measuring the blood pressure levels in the data input portion 42*b* and at the same time the temperature control mode is switched to the blood pressure management mode. Thereafter, the display device 41 displays a variety of the avatars, and if the user chooses one of a variety of the avatars through the data input portion 42*b*, the measured blood pressure levels are stored in correspondence to the individual avatar.

Of course, the blood pressure levels input through the data input portion 42*b* should contain the systolic and diastolic blood pressure levels.

Next, in steps S43 and S44, the individual measured blood pressure levels input in step S42 are accumulatively stored according to measuring dates, and the health condition is assessed by comparing the individual measured blood pressure levels with the standard blood pressure levels (see steps S43 and S44).

Here, the data processing portion 43*b* receives the measured blood pressure levels from the data input portion 42*b* and simultaneously recognizes the date in itself, and then accumulatively stores the measured blood pressure levels in the data storing portion 43*a* according to dates and analyzes the health condition by comparing the measured blood pressure levels with the standard blood pressure levels.

At this time, the standard systolic blood pressure level is in the range of 140-100 mmHg and the standard diastolic blood pressure level is in the range of 90-70 mmHg. When the health condition is analyzed in the data processing portion 43*b* based on the standard systolic and diastolic blood pressure ranges, it is specifically analyzed that the health condition is normal if the measured blood pressure levels are in the standard systolic and diastolic blood pressure ranges, is high blood pressure if the measured blood pressure levels are higher than the standard systolic and diastolic blood pressure ranges, and is low blood pressure if the measured blood pressure levels are lower than the standard systolic blood pressure ranges.

Of course, the data processing portion 43*b* analyzes the health condition as described above. However, the health condition may be analyzed on the basis of the change of the blood pressure levels for a predetermined period or within the predetermined number of times. The health condition so analyzed is also stored in the data storing portion 43*a*.

Next, in steps S45 and S46, the change of the measured blood pressure levels accumulatively stored in S43 and thus the health condition data are displayed for each individual avatar. Additionally, a time for checking a blood pressure is determined on the basis of the change of the measured blood pressure levels and the measuring date, and it is also displayed for each individual avatar (see steps S45 and S46).

At this time, the data processing portion 43*b* causes the display device 41 to display the measured blood pressure levels together with the standard blood pressure levels in figures in correspondence to the individual avatar or to display the change of the systolic and diastolic blood pressure levels or the health condition, which is additionally stored, in the form of graphs and the like. Thus, the data processing portion 43*b* makes it possible to easily manage and analyze the change of the individual blood pressure levels and to attract the attention for high or low blood pressure.

Particularly, the data processing portion 43*b* determines a time for checking the blood pressure and then informs the user of the time in letters, sounds or the like for each individual avatar. Here, the time for checking the blood pressure is set either to be early as the change of the measured blood pressure levels is markedly large or to be informed to the user in the form of the measuring dates with a regular interval.

Further, the data processing portion 43*b* causes the display device 41 to display even the menu and the art of cooking thereof in addition to the changes of the measured blood pressure levels, the changes of the health condition, and the time for the blood pressure test, thereby making it possible to easily prevent and manage a disease such as high blood pressure or low blood pressure.

Basically, a fifth embodiment of the present invention has the configuration and operation similar to the fourth embodiment of the present invention. However, the fifth embodiment is characterized in that the figures and motions of the avatar vary according to a user's blood sugar condition.

Hereinafter, the fifth embodiment will be described mainly in view of differences from the fourth embodiment.

FIG. 13 is a block diagram showing the fifth embodiment of the present invention.

As shown in the figure, an input device 52 according to the fifth embodiment comprises a mode switching portion 52*a* for setting one of the temperature control mode and a blood sugar management mode, a data input portion 52*b* for allowing individual measured blood sugar levels to be directly input in the blood sugar management mode, and a data measuring portion 52*c* for directly measuring the individual blood sugar levels.

The data input portion 52*b* or the data measuring portion 52*c* causes the blood sugar levels to be inputted for each individual in the blood sugar management mode but when the measured blood sugar levels are input into a control device, allows the measured blood sugar levels to be displayed on a display device 51 in accordance with the individual avatar such that the user can know the measured blood sugar level.

Particularly, the data input portion 52*b* is configured to allow the previously measured blood sugar levels to be input in the form of numerals and the like, and particularly, a before-meal blood sugar level measured before a meal and an after-meal blood sugar level measured after a meal to be separately input.

On the contrary, the data measuring portion 52*c* preferably includes a noninvasive blood sugar sensor installed to a side of the refrigerator. The noninvasive blood sugar sensor that utilizes a technique for measuring a blood sugar level without blood collecting measures a blood sugar level based on the technical features that a radio wave traveling toward a blood flow is different from a radio wave returning from the blood flow according to the concentration of the blood sugar in the blood flow.

In addition, it is preferred that the data measuring portion 52*c* be covered with an additional cover (not shown) so as to be exposed to the outside only when a blood sugar level is measured although the data measuring portion 52*c* is mounted to each door handle of the refrigerator and the cover be mounted to the data measuring portion 52*c* so as to be opened and closed.

At this time, since the data measuring portion 52*c* is connected to the control device 53, it is preferred that even though there is not provided the mode switching portion 52*a* for performing the switching to the blood sugar management mode in which a blood sugar level is separately measured and displayed, a mode is automatically switched to the blood sugar management mode when it is determined that the body is brought into contact with the data measuring portion 52*c*.

In the meantime, the control device 53 comprises a data storing portion 53*a* in which the before-meal blood sugar levels and the after-meal blood sugar levels are accumulatively stored according to the dates in blood sugar management mode, and a data processing portion 53*b* for causing the display device 51 to display the change of the blood sugar levels stored in the data storing portion 53*a* and accordingly the change of the health condition.

Here, the data storing portion 53*a* can be configured to accumulatively store the measured blood sugar levels such as the before-meal blood sugar levels and the after-meal blood sugar level to be classified by date or to additionally contain menus and the arts of cooking thereof appropriate according to a blood sugar level so as to provide a dietary treatment connected with diabetes.

Particularly, the data processing portion 53*b* assesses the health condition by comparing the before- and after-meal blood sugar levels with the respective standard blood sugar levels, and causes the display device 51 to display the health condition together with the measured blood sugar levels in correspondence to the individual avatar. At this time, it is possible to cause the display device 51 to display the changes of the measured blood sugar levels and the health condition for a predetermined period in correspondence to the individual avatar.

In general, the standard blood sugar level is set to be lower before a meal, i.e., when a stomach is empty, but to be higher after a meal, and is changed according to whether or not water is taken. If a blood sugar level when a stomach is empty is 140 mg/dl or more or a blood sugar level after water containing glucose of 75 g is taken is 200 mg/dl or more, the user is diagnosed as diabetes. On the basis of the standard, a patient with diabetes needs to control his or her blood sugar level by a dietary treatment or medicine so that a blood sugar level when a stomach is empty in the morning is 120 mg/dl or less and a blood sugar level at two hours after a meal is 150 mg/dl or less.

In addition, the data processing portion 53*b* can check the health condition and accordingly provide a dietary treatment in consideration of the measured blood sugar levels or the change thereof. To this end, after separately receiving user's body information such as sex, age, and weight, in consideration of caloric intake, nutrients necessary, and the like per day on the basis of the body information, it is possible to make the recommendable menu and cause the display device 51 to display it.

For example, a generally overweight person needs to intake 20-25 kcal per a standard weight of 1 kg, a not fat, light worker does 30 kcal/kg, a not fat, general worker does 35-40 kcal/kg, and a not fat, heavy worker does 40-45 kcal/kg. As an example, in a case of a grown-up light worker of 165 cm and 80 kg in stature and weight, since a standard weight of an adult is 60 kg, he or she needs to intake 20-25 kcal/kg, i.e., 1200-1500 kcal per day in order to reduce his or her weight.

Of course, a method for making a menu is similar to that of the fourth embodiment of the present invention.

FIG. 14 is a flowchart showing an operating state of the avatar refrigerator according to the present invention. Hereinafter, the operation of the present invention so configured will be described with reference to FIG. 14. First, in steps S51 and S52, if a mode is switched to the blood sugar management mode, before/after-meal blood sugar levels are input or blood sugar levels are directly measured for each individual avatar (see steps S51 and S52).

Hereafter, if the before-meal blood sugar level and the after-meal blood sugar level are directly and separately input in the form of numerals through the data input portion 52*b*, the measured blood sugar levels are stored for each individual avatar.

In the meantime, in a case where the blood sugar levels are directly measured in the data measuring portion 52*c*, even if the mode switching portion 52*a* is not pressed, the measured blood sugar levels are automatically input and at the same time the temperature control mode is switched to the blood sugar management mode. Thereafter, the display device 51 displays a variety of the avatars, and if the user chooses one of a variety of the avatars through the data input portion 52*b*, the measured blood sugar levels are stored in correspondence to the individual avatar.

At this time, since the data measuring portion 52*c* comprises the noninvasive blood sugar sensor, if the user brings a region of his or her body such as a finger into contact with the data measuring portion, the blood sugar level is measured.

Of course, even though the blood sugar levels are measured through the data measuring portion 52*c*, the data input portion 52*b* classifies the measured blood sugar levels into the before- and after-meal blood sugar levels.

Next, in steps S53 and S54, the individual measured blood sugar levels input in step S52 are accumulatively stored according to measuring dates, and the health condition is checked by comparing the individual measured blood sugar levels with the standard blood sugar levels (see steps S53 and S54).

Here, after separately receiving the respective before- and after-meal blood sugar levels from the data input portion 52*b* or the data measuring portion 52*c*, the data processing portion 53*b* analyzes the health condition by comparing the respective measured blood sugar levels with the standard blood sugar levels.

At this time, the health condition can be analyzed in consideration of the changes of the before- and after-meal blood sugar levels, as well as the before- and after-meal blood sugar levels are analyzed by comparing them with the standard blood sugar levels.

For example, the standard blood sugar level before a meal is set higher than that after a meal, and it is considered as a normal condition that a blood sugar level when a stomach is empty is 140 mg/dl or less or a blood sugar level after water containing glucose of 75 g is taken is 200 mg/dl or less. Since the standard blood sugar levels may be changed according to mealtime, water intake, and the like, to correctly determine the health condition, it is preferred that a blood sugar level be measured in a state of where water is not taken when a stomach is empty.

Of course, the data processing portion 53*b* accumulatively stores the measured blood sugar levels measured according to date for a predetermined period, and checks the health condition in consideration of the change of the measured blood sugar levels.

In addition, the data processing portion 53*b* makes it possible to provide a dietary treatment connected with diabetes in consideration of the change of the measured blood sugar levels and accordingly the health condition. At this time, a menu is made so that total calorie intake for a day is determined in consideration of the standard weight which is calculated from sex, age, and weight separately input and all of a variety of nutrients are contained in a range of the total calorie intake. Furthermore, the menu may be selected among previously input menus or may be again prepared in various ways.

Further, it is more preferred that the data processing portion 53*b* also provide the art of cooking of food included in the menu as well as the menu. All of the menu, the art of cooking, and the like provided from the data processing portion 53*b* are selected from the data previously stored in the data storing portion 53*a*.

Next, in step S55, the change of the measured blood sugar levels accumulatively stored in step S53 and accordingly the health condition are displayed in accordance to the individual avatar (see step S55).

At this time, the data processing portion 53*b* causes the display device 51 to display the measured blood sugar levels together with the standard blood sugar levels in figures in accordance to the individual avatar, or the change of the individual blood sugar levels to be easily managed and analyzed by displaying the change of the measured blood sugar levels or the health condition additionally stored in the form of graphs, thus making it possible to attract the attention for diabetes.

Of course, even the menu and the art of cooking provided from the data processing portion 53*b* are also displayed through the display device 51, and accordingly the blood sugar level can be easily controlled by the dietary treatment, so that it is possible to prevent and manage a disease such as diabetes.

A sixth embodiment of the present invention has the fundamentally same configurations as the fourth embodiment of the present invention. However, the sixth embodiment is characterized in that the figure and motion of the avatar is changed according to user's body fat. That is, in the sixth embodiment, the data input, processed, and displayed are connected with body fat.

Hereinafter, the sixth embodiment will be described mainly in view of differences from the fourth embodiment.

FIG. 15 is a block diagram showing the sixth embodiment of the present invention.

As compared with FIG. 10, the sixth embodiment of the present invention is the same as the fourth embodiment in that the sixth embodiment comprises an input device 62, a mode switching portion 62*a*, a data input portion 62*b*, a control device 63, a data storing portion 63*a*, a data processing portion 63*b* and a display device 61.

However, the sixth embodiment is different from fourth embodiment in that the sixth embodiment uses a percent body fat as a parameter. Particularly, the data processing portion 63*b* stores user's body information and measured values of the percent body fat input through the data input portion 62*b* in the data storing portion 63*a*. At this time, the user's body information, the measured values of the percent body fat, and like are accumulatively stored in correspondence to the individual avatar, so that the more correct health condition and accordingly the prescriptions are provided after the date accumulatively stored for a predetermined period are analyzed.

Specifically, the data processing portion 63*b* calculates a body mass index (BMI) on the basis of the user's body information. In general, the BMI is a value (kg/m$^2$) obtained by dividing user's body weight by the square of stature. Here, it is considered that the BMI of 20 or less indicates underweight, the BMI of 20-24 indicates normal weight, the BMI of 25-29 indicates overweight, and the BMI of 30 and more indicates fatness.

In addition, the data processing portion 63*b* receives the measured values of the percent body fat and body composition and the like and compares them with standard percent body fat and standard body composition according to each body region. Accordingly, the health condition connected with fatness is more correctly determined.

As described above, the data processing portion 63*b* determines the health condition connected with fatness and provides appropriate food and exercise prescriptions based on the individual body information and health condition. At this time, the food prescription provides recommendable menus in consideration of calorie, nutrients, and the like, and the exercise prescription provides recommendable exercise items in consideration of body fat consumption, muscular strengthening, and the like. Such food and exercise prescriptions also use the data stored in the data storing portion 63*a*.

FIG. 16 is a flowchart showing an operating state of the sixth embodiment of the present invention. Hereinafter, the operation of the present invention so configured will be described with reference to FIG. 16.

First, in steps S61 and S62, if a mode is switched to a medical checkup mode, the body information and the measured values of the percent body fat are input and stored in correspondence to the individual avatar (see steps S61 and S62).

Here, the user presses the mode switching portion 62*a* to change the temperature control mode to the medical checkup mode, chooses one of the avatars, and then inputs the body information and the measured values of percent body fat into the data processing portion 63*b* in correspondence to the individual avatar.

Next, in steps S63 and S64, the body mass index is calculated and displayed according to the body information input in S61, and then, the health condition is examined by comparing the percent body fat with the body mass index (see steps S63 and S64).

Here, the data processing portion 63*b* calculates the body mass index in consideration of the stature and weight among the body information and checks the health condition connected with fatness. At this time, it is considered that the body mass index lower than a predetermined range indicates underweight while the body mass index higher than a predetermined range indicates overweight or fatness.

In addition, the data processing portion 63*b* determines the health condition connected with fatness by comparing the measured values of the percent body fat with the standard values of the percent body fat. At this time, the data processing portion 63*b* makes it possible to determine the health condition connected with fatness in detail by receiving the measured values of the body composition including the values of the percent body fat for each body region.

Next, in steps S65 to S67, the food and exercise prescriptions are provided according to the health condition examined in step S64. At this time, the individual health conditions and a variety of prescriptions are accumulatively stored and simultaneously displayed in correspondence to the individual avatar (see steps S65, S66, and S67).

Here, the data processing portion 63*b* provides the food and exercise prescriptions selected from a variety of information on food and exercise stored in the data storing portion 63*a* according to the health condition calculated by comparing the various data with the standard data.

Of course, the measured values of the body information, percent body fat, and the like input in the data processing portion 63*b*, the health conditions according thereto, a variety of the prescriptions, and the like are accumulatively stored in the data storing portion 63*a* in correspondence to the individual avatar. On the basis of the date accumulatively stored as above, by examining the correct health condition connected with fatness and additionally providing a variety of the prescriptions appropriate thereto, it is possible to more effectively manage the health condition for a long period of time.

A seventh embodiment of the present invention is configured and operates fundamentally similar to the fourth embodiment of the present invention. However, the seventh embodiment is characterized in that the figure and motion of the avatar is changed according to an exercise item recommended by the user.

Hereinafter, the seventh embodiment will be described mainly in view of differences from the fourth embodiment.

FIG. 17 is a block diagram showing the seventh embodiment of the present invention.

As shown in the figure, the seventh embodiment has the fundamentally same configurations as the fourth embodiment except that an input device 72 further comprises an exercise input portion 72*c* and a time input portion 72*d* and a control device 73 further comprises a date and time counting device 73*c*.

The input device 72 comprises a mode switching portion 72*a* for setting one of the temperature control and exercise management modes, and a data input portion 72*b* for allowing the individual body information to be input in the exercise management mode.

At this time, the mode switching portion 72*a* causes the temperature control mode for controlling the temperatures in the freezing and refrigerating chambers and the exercise management mode for allowing the individual body information to be input and providing the recommendable exercise items and the calorie consumptions caused therefrom to be switched to each other. Particularly, if the exercise management mode is set, one of a variety of the avatars displayed on a display device 71 is chosen. The data necessary in the respective modes are input through the data input portion 72*b*.

Specifically, the data input portion 72*b* allows the detailed body information to be individually input in the exercise management mode. When the body information is input into the control device 73, the display device 71 displays the body information in correspondence to the individual avatar to let the user know it.

Therefore, after the mode switching portion 72*a* switches a mode to the exercise management mode, when the body information is input through the data input portion 72*b*, the control device 73 causes the recommendable exercise items and the corresponding calorie consumptions to be displayed. Further, the input device 72 comprises the exercise input portion 72*c* for allowing the user to choose a desired one of the recommendable exercise items displayed on the display device 71, and the time input portion 72*d* for allowing an exercise time for the exercise item chosen through the exercise input portion 72*c* to be input.

Of course, the exercise input portion 72*c* allows one of the recommendable exercise items displayed on the display device 71 to be simply chosen, but another exercise item to be chosen by inputting the name thereof.

Particularly, the time input portion 72*d* allows the user to simply input the time for which the user wants to take exercise in practice. Alternatively, there are provided an exercise start button (not shown) for inputting the start of the exercise and an exercise stop button (not shown) for inputting the end of the exercise, and the start and stop buttons are connected to a date and time counting portion 73c additionally included in the control device 73, thereby making it possible to automatically count the practical exercise time.

As described above, it is possible to input the body information in the health management mode through the mode switching portion 72*a* and the data input portion 72*b*, to provide the recommendable exercise items and the calorie consumptions caused therefrom, to allow one of the recommendable exercise items to be chosen and the exercise time to be input through the exercise input portion 72*c* and the time input portion 72*d*, and to provide the practical calorie consumption caused therefrom.

Next, the control device 73 comprises a data storing portion 73*a* in which a variety of the standard data and input data are stored in the exercise management mode, a data processing portion 73*b* for providing the recommendable exercise items and the calorie consumptions caused therefrom on the basis of the body information input through the data input portion 72*b* by using the standard data stored in the data storing portion 73*a*, and the aforementioned date and time counting portion 73*c*.

Specifically, an exercise table showing calorie consumption according to weight, exercise items, and exercise durations is stored in the data storing portion 73*a*. According to the exercise table, the calorie consumption is set to be large as the weight and the exercise time are increased. In addition, the body information input through the data input portion 72*b* is accumulatively stored in correspondence to the individual avatar in the data storing portion 73*a*.

Further, the data processing portion 73*b* causes the display device 71 to display the more correct recommendable exercise items and the calorie consumptions caused therefrom by analyzing the body information accumulatively stored in the data storing portion 73*a* for a predetermined period, or causes the display device 71 to display a variety of exercise items and the calorie consumptions caused therefrom by displaying the exercise table stored in the data storing portion 73*a* although the body information is not input in the data storing portion 73*a*.

FIG. 18 is a flowchart showing the operating state of the seventh embodiment of the present invention.

Hereinafter, the operation of the seventh embodiment will be described with reference to FIG. 18.

First, in steps S71 and S72, if a mode is switched to the exercise management mode, the body information is input and stored in correspondence to the individual avatar (see steps S71 and S72).

Here, the user presses the mode switching portion 72*a* to switch the temperature control mode to the exercise management mode, chooses one of the avatars, and then, inputs the body information into the data processing portion 73*b* in correspondence to the individual avatar.

Next, in step S73, the recommendable exercise items and the calorie consumptions caused therefrom are selected and displayed according to the body information input in step S72 (see step S73).

At this time, the data processing portion 73*b* selects the recommendable exercise items in consideration of age and weight among the body information. For example, as the user is old or heavy, the recommendable exercise items are selected to avoid hard exercise items causing excessiveness to joints.

In addition, the data processing portion 73*b* causes the display device 71 to display the recommendable exercise items so selected and the calorie consumptions caused therefrom and to display the exercise table showing the calorie consumptions according to exercise durations, weight and exercise items. For example, as the exercise is hard, the exercise time is long, or the user is heavy, the calorie consumption is set to be large.

In steps S74 to S76, one of the recommendable exercise items selected in step S73 is chosen and simultaneously the exercise time is input. Then, the practical calorie consumption according to the chosen exercise item is calculated and accumulatively stored, and simultaneously is displayed in correspondence to the individual avatar (see steps S74, S75, and S76)

Here, if the data processing portion 73*b* causes the display device to display the selected exercise items selected according to the body information, the user chooses desired one of the recommendable exercise items through the exercise input portion 72*c* and inputs the exercise time for the chosen exercise items through the time input portion 72*d*.

At this time, the user may directly input the exercise time through the time input portion 72*d* before or after taking exercise, and the practical exercise time is input into the data processing portion 73*b*.

However, if a signal is generated by pressing the exercise time button of the time input portion 72*d* when starting taking exercise, the date and time counting portion 73*c* connected thereto starts counting the exercise time. If a signal is generated by pressing the exercise stop button of the time input portion 72*d* when stopping taking exercise, the date and time counting portion 73*c* connected thereto stops counting the exercise time. Then, the practical exercise time is automatically calculated and input into the data processing portion 73*b*.

If the practical exercise time is input into the data processing portion 73*b* as above, the data processing portion 73*b* calculates and accumulatively stores the calorie consumption by the practical exercise in consideration of the practical exercise time. It is possible to effectively manage the exercise for a long time as well as to provide the various recommendable exercise items on the basis of the accumulated data.

An eighth embodiment of the present invention is configured and operates fundamentally similar to the preferred embodiment of the present invention. However, the eighth embodiment is characterized in that the avatar shows the number and pattern of opening and closing a refrigerator door. Thus, there is not provided an input device since data need not be input from the outside.

However, in order to select an avatar, the eighth embodiment comprises a contact detecting sensor for detecting whether a refrigerator door is opened or closed, and a counter and a timer for accumulatively storing the number of times the door is opened and closed according to time. Further, there is provided a user identification device for showing the data according to a user.

Hereinafter, the eighth embodiment will be described mainly in view of differences from the preferred embodiment of the present invention.

FIG. 19 is a block diagram showing the eighth embodiment of the present invention.

As shown in the figure, in the eighth embodiment of the present invention, a refrigerator main body is mounted with a control device 83 for controlling the operation of a variety of constitutional parts, and the front surface of the freezing chamber door is mounted with a display device 81 for displaying the operating state of the refrigerator. When contact detecting sensors 82*a*, which are respectively installed between the refrigerator main body and freezing and refrigerating chamber doors 2*a* and 2*b*, detect whether the refrigerator doors are opened or closed and generate signals, a user identification device 82*b* installed in the refrigerator main body or the door identifies the user who opens the door, and the control device 83 receives the signals from the contact detecting sensors 82*a* and the user identification device 82*b*, analyzes the door opening and closing information, and causes the display device 81 to display the information.

At this time, the contact detecting sensors 82*a* are respectively installed between the main body and the freezing and refrigerating chamber doors and connected to the control device 83. The contact detecting sensors 82*a* operate in such a manner that the electrical signals are generated when the respective doors are closed with respect to the main body whereas the electrical signals are interrupted when the respective doors are opened with respect to the main body, and vice versa.

Therefore, since the contact detecting sensor 82*a* generates a different signal according to whether each door is opened or closed, the control device 83 receives the information on the opening and closing for the door by determining the signal generated from the contact detecting sensor 82*a*.

Next, in order to identify the user who opens the door, the user identification device 82*b* may include a camera capable of identifying the user by determining features and the like by an image, a fingerprint identification unit capable of identifying the user by individually identifying an inherent fingerprint, or an iris identification unit capable of identifying the user by individually identifying an inherent iris.

At this time, the user identification device 82*b* such as the camera, the fingerprint identification unit, or the iris identification unit is installed to the refrigerator main body or each door and connected to the contact detecting sensors 82*a*, thereby identifying the user who opens the door. Also, the user identification device 82*b* is connected to the control device 83, and thus, transmits the user identification information obtained from the user identification device 82*b* to the control device 83. At this time, the control device 83 internally identifies the user and causes the corresponding avatar to be set.

In addition, the user identification device 82*b* may include an additional input device for allowing the user to directly set his/her avatar.

Next, when receiving the information on the opening and closing of the respective doors according to the signals transmitted from the contact detecting sensors 82*a* and the user identification device 82*b*, the control device 83 receives and analyzes the opening and closing information such as the number of times the door is opened and closed, a door opening and closing time, a door open duration, and the user who opened the door.

Preferably, the control device 83 comprises a counter 83*a* for counting the number of times the door is opened and closed through the signals transmitted from the contact detecting sensor 82*a*, a timer 83*b* for detecting the door opening and closing time, and the door open duration through the signals transmitted from the contact detecting sensor 82*a*, and a data processing portion 83*c* for causing the display device 81 to display the number of times the door is opened and closed calculated from the counter 83*a*, the door opening and closing time, and the door open duration calculated from the timer 83*b*.

Here, the counter 83*a* receives the signals generated from the contact detecting sensor 82*a*, and recognizes and counts the number of times the door is opened and closed by adding '1' when the door is opened or closed. On the other hand, the timer 83*b* detects the door opening and closing time when the door is opened or closed or calculates the door open duration from the time when the door is opened to the time when the door is closed.

Further, the data processing portion 83*c* causes the display device 81 to display the number of times the door is opened and closed, the door opening and closing time, and the door open duration transmitted from the counter 83*a* and the timer 83*b* together with the avatar. At this time, for example, the display device 81 displays the number of times the door is opened and closed, the door opening and closing time, and the door open duration for a predetermined period such as a day or a month.

In addition, the data processing portion 83*c* accumulatively stores the number of times the door is opened and closed, the door opening and closing time, or the door open duration individually according to the avatar corresponding to the user who opens the door when the user's identification information such as the features, the fingerprint, or the iris pattern obtained from the user identification device 82*b* is input. Further, the data processing portion 83*c* accumulatively stores the compressor operating time and the power consumption, and causes the display device to display the compressor operating time and consumption power as well as the number of times the door is opened and closed, the door opening and closing time, and the door open duration individually according to the user.

In the meantime, the display device 81 is connected to the data processing portion 83*c* and displays the number of times the door is opened and closed, the door opening and closing time, the door open duration, and the operating time and consumption power of the compressor together with the avatar according to hours, dates and users. At this time, the number of times the door is opened and closed, the door opening and closing time, the door open duration and the operating time and the consumption power of the compressor for a predetermined period are together displayed, thereby attracting the user's attention.

When the number of times the door is opened and closed, the door open duration, and the compressor operating time exceed the predetermined number, the predetermined time, and the predetermined operating time, respectively, the data processing portion 83*c* may generate an additional warning signal and cause the display device 81 to display the warning signal in the form of warning letters, a warning sound, a warning lamp, or the like.

FIG. 20 is a flowchart showing the operating state of the avatar refrigerator according to the eighth embodiment of the present invention;

Hereinafter, the operation of the eighth embodiment of the present invention will be described with reference to FIG. 20.

First, steps S81 to S84, when the user opens a door with respect to the refrigerator main body, the open state of the door is detected, the user who opens the door is identified, and at the same time the door opening time and the door open duration are measured (see steps S81, S82, S83, and S84).

At this time, whether the doors are opened or closed with respect to the refrigerator main body is determined by the contact detecting sensors 82*a*, which are separately installed between the refrigerator main body and the freezing chamber door 2*a* and between the refrigerator main body and the refrigerating chamber door 2*b* and generate the signals when the doors are opened with respect to the refrigerator main body.

Then, the control device 83 determines whether the doors are opened or closed according to the signals transmitted from the respective contact detecting sensors 82*a*. If it is determined from the respective contact detecting sensors 82*a* that at least one of the doors is opened, the identification information on the user who opens the door is identified by the user identification device 82*b*. At this time, the control device 83 automatically sets the individual avatar according to the identification information such as the features, the fingerprint, the iris pattern or the like or makes it possible to set the individual avatar by allowing the user to separately choose it, and thereafter, accumulatively stores the door opening and closing information according to an individual.

In addition, if it is determined by the respective contact detecting sensors 82*a* that at least one of the doors has been opened, the timer 83*b* measures the door opening time and also the door open duration by means of the contact detecting sensor 82*a*.

Of course, the timer 83*b* may measure the door opening time when the door is opened and the door closing time when the door is closed, and calculate the door open duration from the time when the door is opened to the time when the door is closed.

Next, steps S85 to S87, when the user closes the door with respect to the refrigerator main body, the door close state is detected, the door closing time is measured, and simultaneously, the number of times the door is opened and closed is counted (see steps S85, S86, and S87).

In the same manner as above, if it is determined by the contact detecting sensor 82*a* that at least one of the doors of the refrigerator main body is closed, the timer 83*b* measures the door closing time and simultaneously, the counter 83*a* accumulatively counts the number of times the door is opened and closed by adding '1' when the door has been closed. At this time, the opening and closing number for each door is counted separately.

Of course, although the counter 83*a* counts the number of times the door is opened and closed when the door is closed, the number of times the door is opened and closed may be counted when the door is opened.

Next, in steps S88 to S800, the number of times the door is opened and closed, the door opening and closing time, and the door open duration obtained in steps S83 to S87 are accumulatively stored; the compressor operating time and power consumption of the compressor while the door is open are calculated and stored; and the number of times the door is opened and closed, the door opening and closing time, the door open duration, and the operating time and the power consumption of the compressor are displayed together with the avatar for a certain period of time (see steps S88, S89, and S800).

At this time, the data processing portion 83*c* accumulatively stores the number of times the door is opened and closed, the door opening and closing time, and the door open duration transmitted from the counter 83*a* and the timer 83*b*, and causes the display device 81 to display the number of times the door is opened and closed, the door opening and closing time, and the door open duration for a predetermined period with the individual avatar or to selectively display the number of times the door is opened and closed and the door open duration with the individual avatar according to an hour.

For example, the number of times the door is opened and closed and the door open duration may be displayed in the manner such as "August 19: the freezing chamber door is opened and closed 5 times, and the refrigerating chamber door is opened and closed 12 times", "August 19: the freezing chamber door is opened for 10 minuets, the refrigerating chamber door is opened for 28 minuets", or "Between 11 to 12 a.m.: the freezing chamber door is opened and closed one time (and is opened 1 minute), the refrigerating chamber door is opened and closed two times (and is opened 5 minutes)". The number of times the door is opened and closed, the door opening and closing time, and the door open duration may be displayed according to days, hours or users.

Further, in order to prevent the temperature in the chamber from being increased by allowing the outside air of a high temperature to be introduced into the chamber when a door is opened, the compressor operates to refrigerate or freeze the interior of the chamber at the same time when the door is opened. At this time, since the data processing portion 83*c* fundamentally controls the operation of the compressor, the data processing portion 83*c* receives the information connected with the operation of the compressor such as the compressor operating time and beforehand calculates the consumption power caused from the compressor operating time, and accumulatively stores them. Then, the display device 81 may display the compressor operating time and the consumption power caused therefrom together with the avatar according to a date or user.

In addition, if the number of times the door is opened and closed is larger than a predetermined number of times, the door open duration is longer than a predetermined duration, or the compressor operating time is longer than a predetermined operating time, the data processing portion 83*c* causes a warning indication such as warning letters, a warning sound or a warning lamp to be displayed on the display device 81, thereby attracting the user's attention for power waste.

A ninth embodiment of the present invention is basically configured and operated similar to the preferred embodiment of the present invention. However, the ninth embodiment is characterized in that the avatar varies according to the user's motion patterns.

Hereinafter, the ninth embodiment will be described mainly in view of differences from the preferred embodiment of the present invention.

FIG. 21 is a block diagram showing the ninth embodiment of the present invention.

As shown in the figure, the refrigerator according to the ninth embodiment of the present invention comprises an image pickup device 95 for taking a motion image of the user; an input device 92 for receiving predetermined commands from the user; a storage device 93 for storing the avatar information, frames (such as a user interface) to be displayed for exercise confirming function services, and standard motion information; a display device 91 for displaying the frames (such as a user interface) to be displayed for the exercise confirming function services, the motion image and/or the standard motion information, a confirmation result of whether or not the user takes exercise, and the like; a date and time counting device 96 for calculating an year, month, day, and/or time; and a control device 98 for storing the user's motion image taken from the image pickup device 95 in the storage device 93 and the motion image and/or the standard motion information to be displayed and for confirming whether or not the user takes exercise, by controlling the aforementioned constitutional elements.

Here, the image pickup device 95 such as a digital camera or digital camcorder takes a motion of the user from the outside of the refrigerator and generates a predetermined motion image. The image pickup device 95 has such a resolution that the motion image of the user can be used for image comparison. Further, the image pickup device 95 takes the user's motion image continuously and generates a moving image, or takes the user's motion image discontinuously and generates a plurality of still images.

In addition, the input device 92, which is a device for receiving the commands (such as choice of the exercise confirming function services, the start of the exercise, the stop of the exercise, the name of the motion, or the kind of the exercise) from the user, is in connection with the frames and the like to be displayed through the display device 91.

In the meantime, the avatar information includes a plurality of avatars (characters), which may be in the form of still or moving images or animations.

Also, the standard motion information, which is data of the standard for the purpose of determining whether or not the user's motion image corresponds to a predetermined motion or exercise, at least includes the motion images (the moving and/or still images) for the predetermined motion or exercise, so that the control device 98 determines the sameness or similarity between the user's motion images and the standard motion information by comparing them through a general image comparison method. In addition, the standard motion information may include numerical data having an angle of the user's body (such as an angle of a stretched or bent knee) and/or an angular velocity of the user's body (such as an angular velocity of an arm) generated by analyzing the predetermined motion or exercise.

The date and time counting device 93 is a device for calculating the time needed to take the user's motion image from the image pickup device 95. Upon the request of the control device 98, information on the year, month, date and time when the request has been received is provided to the control device 98.

FIG. 22 is a flowchart showing an operation order of the ninth embodiment of the present invention.

As shown in the figure, in step S91, the control device 98 first causes the user interface, which allows the user to choose the exercise confirming function services, to be read out from the storage device 93 and then displayed on the display device 91. When the user chooses the exercise confirming function services, the control device causes the user interface, which allows the user to input the name of motion or the name or kind of exercise that the user wishes to take, to be read out from the storage device 93 and then to be displayed on the display device 91. Then, the control device 98 receives the name of the motion or the name or kind of the exercise input by the user through the input device 92.

In step S92, if the control device 98 receives the user's input indicating the "start exercise" from the input device 92, the process goes to step S93. Otherwise, the process waits until the input indicating the "start exercise" is received. After the "start exercise" is input, the user performs a predetermined exercise or motion. At this time, in order to obtain an exercise start time, the control device 98 receives the current date and time from the date and time counting device 96 and stores the current date and time in the storage device 93.

In step S93, the control device 98 transmits an image taking command to the image pickup device 95, and then, the image pickup device 95 takes the image of the user's motion or exercise and transmits it to the control device 98. At this time, the image pickup device 95 may take the image of the user's motion or exercise continuously or discontinuously. The continuously or discontinuously taken image may be distinguished according to the kind of the motion or exercise.

In step S94, the control device 98 determines whether the user inputs the "stop exercise" through the input device 92. If the user stops the motion or exercise and inputs the "stop exercise," the process goes to step S95. Otherwise, the process goes to step S93 and the control device 98 causes the image pickup device 95 to take the motion image in succession. At this time, in order to obtain an exercise stop time, the control device 98 receives the current date and time from the date and time counting device 96 and stores the current date and time in the storage device 93.

In step S95, the control device 98 reads the user's motion image and/or the standard motion information previously stored in the storage device 93 and corresponding to the name of motion or the name or kind of exercise input in step S91 and then causes the image and/or information to be displayed on the display device 91, so that the user can directly watch the motion image and/or the standard motion information to confirm whether the user performs the predetermined motion or exercise. Here, the user may be a person who practically took exercise or not. According to the confirmation whether the user took exercise, the control device 98 determines that the user took exercise. Then, if the determination result is input through the input device 92, the process goes to step S96. Otherwise, the process is terminated.

In step S96, the control device 98 stores the determination result of the user's motion or exercise into the storage device 93. At this time, the control device 98 stores a date when the user took the motion or exercise and a duration when the user took the motion or exercise (the exercise finish time−the exercise start time) together with the determination results into the storage device 93, and thus, stores the information on an amount of user's exercise. Further, the control device 98 may cause the information on an amount of the user's exercise to be displayed on the display device 91.

In the aforementioned step S95, the control device 98 further reads the standard motion information previously stored in the storage device 93, compares it with the received motion image, and systematically determines whether or not the user takes exercise. At this time, the control device 98 reads the standard motion information corresponding to the name of the motion or the name or kind of the exercise input in step S91 from the storage device 93, and compares the read standard motion information with the motion image. For example, if the standard motion information includes image information, the control device 98 uses an image comparison method. On the other hand, if the standard motion information is numerical data, the control device 98 analyzes the user's motion or exercise stored in the motion image, converts the analyzed motion or exercise to predetermined numerical data and then compares the predetermined numerical data with the standard motion information corresponding to the name of motion or the name or kind of exercise input in step S91 to determine the sameness or similarity between the user's motion or exercise and the standard motion information. If the user's motion or exercise is identical or similar to the standard motion information, the process goes to step S96. Otherwise, the process is terminated since the user performs wrong motion or no motion nor exercise.

Here, in the refrigerator having the exercise confirming function according to the present invention, the name of motion or the name or kind of exercise may be input in step S95 without performing step S91. Alternatively, step S91 may be performed between steps S94 and S95.

A tenth embodiment of the present invention is configured and operates fundamentally similar to the preferred embodiment of the present invention. However, the tenth embodiment is characterized in that the avatar gradually grows according to a condition such as a time, user's state, or the like. At this time, the user may use the growth of the avatar as a game. In the specification, the tenth embodiment will be described with an example of the user's percent body fat described in the sixth embodiment as an example of the user's state.

Therefore, hereinafter, the tenth embodiment will be described mainly in view of differences from the preferred and sixth embodiments of the present invention.

FIG. 23 is a block diagram showing the tenth embodiment of the present invention.

As shown in the figure, the tenth embodiment of the present invention comprises a display device 101 for visually displaying avatars having a variety of external appearances; an input device 102 through which a period for an avatar breeding game service, a predetermined breeding command from the user, or information on the food ingested by the user is input; a storage device 103 for storing a variety of data on avatar with different external appearances according to growth degrees, growth data at which the growth degree of the avatar chosen by the user is numerically represented, and user's health condition information; an avatar breeding device 106 for updating the growth data according to the user's health condition information; a body fat measuring device 105 for providing body fat level after measuring user's body fat; and a control device 108 which stores the body fat level in the storage device 103 by adding the body fat level from the body fat measuring device 105 to the health condition information, transmits the growth data and the health condition information to the avatar breeding device 106 after reading the data and information from the storage device 103, reads the avatar data in accordance with the growth degrees in the growth data from the storage device 103 after receiving the growth data from the avatar breeding device 106 and then causes the avatar of the read avatar data to be displayed on the display device 101.

The display device 101 displays menus (user interface) for allowing the user to choose an avatar and to input the period of the avatar breeding game service, the breeding command, the body fat level (which may be input through the body fat measuring device 105), and the information on the ingested food, and also displays the avatar and the breeding state of the avatar.

In addition, the input device 102 corresponds to the user interface for allowing the user to choose an avatar and to input the period of the avatar breeding game service, the breeding command, the body fat level (which may be input through the body fat measuring device 105), and the information on the ingested food.

Next, the storage device 103 stores the user interface for allowing the user to choose an avatar and to input the period of the avatar breeding game service, the breeding command, the body fat level (which may be input through the body fat measuring device 105), and the ingested food information on the ingested food and also stores the breeding state data, the aforementioned avatar data, the growth data, and the health condition information.

Here, the breeding state data includes data connected with a space in and a state under which the user's avatar lives, i.e., data regarding the state connected with the user's breeding command, such as a state where fish are in the sea in the morning, a state where circumstances are messed, a state where there is a young, or the like.

In addition, the avatar data are connected with the avatars having external features different from each other according to the avatar growth degree corresponding to the growth data, wherein the external features include stature, weight, skin color, clothes, facial expression, and the like. At this time, the avatar data include a variety of avatars (such as a bear and fox) having different external features according to the kinds.

Next, the growth data, which are numerically represented by the avatar breeding device 106, means the growth information of the avatar. For example, like the external features of the avatars, the growth data include a stature factor, a weight factor, a skin color factor, a clothes factor, a facial expression factor, and the like. The growth data to which the respective factors are currently applied are calculated on the basis of the user's health condition information and/or the breeding command.

In addition, for example, the health condition information includes the user's fundamental health information (such as age, stature, weight, and sex) and the information on the ingested food or the user's body fat level. On the basis of the user's health information, the weight factor of the growth data is increased if the body fat level is high, and vice versa; and the weight or facial expression factor is increased if the calorie according to the food information is high, and vice versa. The above information is closely correlated with the growth data. Here, the food information includes the calorie intake which is directly input by the user and the calorie information on the respective foods.

In addition, the avatar breeding device 106 manages the general progress of breeding the avatar. When the avatar chosen by the user lives under the aforementioned breeding state, on the basis of the health condition information, or on the basis of the health condition information and the breeding command input by the user, the growth data of the current avatar are updated and the updated growth data are provided to the control device 108. The growth data are calculated only by the health condition information or by the connected health condition information and breeding command, as described above. Here, the breeding command is connected with user's disposal method under the state according to the given growth data, such as "feeding", "cleaning", or "soothing". At this time, the avatar breeding device 106 also causes whether or not the user timely provides the breeding command under the breeding state of the breeding state data to influence the growth data. For example, when the avatar is hungry, since a case where the user inputs the breeding command of "feeding" within thirty seconds is different from a case where the user inputs the breeding command of "feeding" after thirty minutes, the growth data are differently influenced.

The body fat measuring device 105 is the same as that described in the sixth embodiment.

Next, the control device 108 provides the predetermined avatar breeding game service for a period input by the user.

FIG. 24 is a flowchart of an avatar breeding game according to the tenth embodiment of the present invention.

First, in step S101, the control device 108 determines whether or not there is the avatar chosen by the user. If the avatar is not chosen, the process goes to step S102. Otherwise, the process goes to step S103.

In step S102, the control device 108 causes the display device 101 to display the user interface for the choice of the avatar (i.e., the kind of the avatar) stored in the storage device 103, receives user's choice command from the input device 102, and stores the chosen avatar as user's avatar in the storage device 103. At this time, the control device 108 may further receive and store a period (opening and closing dates, or a service period) for providing the avatar breeding game service.

In step S103, the control device 108 causes the display device 101 to display a breeding state after reading the breeding state data from the storage device 103, and to display an avatar from the avatar data corresponding to the kind of the avatar chosen by the user (alternatively, an avatar corresponding to the previous growth data or a default avatar). At this time, the control device 108 does not read the breeding state data when only the user's health condition information is used as the basis of the growth data.

In step S104, the control device 108 causes the avatar breeding game to be progressed. Thus, the control device 108 causes the display device 101 to display the user interface after reading the user interface for allowing the user's breeding command to be input from the storage device 103, or receives the user's breeding command from the input device 102. The input breeding command is transmitted to the avatar breeding device 106 together with the breeding state data. At this time, the control device 108 does not perform step S104 when only the user's health condition information is used as the basis of the growth data.

In step S105, the control device 108 directly receives the user's body fat level through the input device 102, or receives the user's body fat level measured by the body fat measuring device 105. In addition, the control device 108 causes the display device 101 to display the user interface for allowing the information on food (or calorie) ingested by the user to be input after reading the user interface from the storage device 103. At this time, in a case where the user directly inputs the calorie intake, the control device 108 may store the input calorie as the health condition information in the storage device 103, or calculate calories separately according to the food information (such as the kind and an amount of the food ingested by the user) input by the user and store the calculated calories as the health condition information in the storage device 103.

In step S106, the avatar breeding device 106 updates the growth data by reading the health condition information or by reading the health condition information and the user's breeding command according to the breeding state. That is, as described above, the suitability or timeliness of the breeding command is considered, and whether the user has an appropriate body fat level or the user intakes an appropriate calorie is considered as the health condition information on the basis of the user's fundamental health information.

In step S107, the avatar breeding device 106 transmits the updated growth data to the control device 108 which in turn reads the avatar data according to the growth degree in the updated growth data from the storage device 103 to maintain or change the avatar previously displayed on the display device 101. The maintenance or change of the avatar visually shows the health condition or ingested calorie information according to the food ingested by the user.

In step S108, the control device 108 receives the command of closing the avatar breeding service from the user or determines whether or not it is a preset closing time of the avatar breeding service, thereby closing the avatar breeding service or going to step S104 to continuously progress the process.

Here, since the growth data are influenced when there is an input from or measurement by the user, step S105 may be performed between steps S103 and S104, steps S106 and S107, or steps S107 and S108 in addition to the current position shown in the flowchart.

FIG. 25 shows an embodiment of the avatar according to the heath condition information and/or food information.

As shown in the figure, the whole external appearance of the same avatar is visually decreased or increased according to the user's health condition information and/or the information on the food ingested by the user.

An eleventh embodiment of the present invention is configured and operates fundamentally similar to the preferred embodiment of the present invention. However, the eleventh embodiment is characterized in that the avatar informs the user of the presence of failure of the refrigerator.

Therefore, the eleventh embodiment will be hereinafter described mainly in view of differences from the preferred embodiment of the present invention.

FIG. 26 is a block diagram showing the eleventh embodiment of the present invention.

A storage device 113 stores avatar information including a plurality of avatars, a control pattern of the refrigerator, messages including determination results of the presence of failure, detailed information connected with the determination results, information on operation states of the refrigerating and freezing chambers, information on a service type of the dispenser, and the like.

In addition, the information on the operation state stored in the storage device 113 includes the whole operation state of the refrigerator such as the control of the current compressor, the operation or not of a fan, the temperatures of the freezing and refrigerating chambers, and the like.

Further, the storage device 113 stores the control pattern of the refrigerator. The control pattern is connected with the information for causing a control device 114 to perform certain operation under a predetermined state (including a state detected by a detecting device or the like not shown). For example, the control pattern includes information to what extent the control device 114 should control the compressor, the fan and the like when the temperature in the refrigerating chamber reaches a specific temperature, information to what extent the temperature in the refrigerating chamber should be changed when the compressor, the fan and the like is operated for a certain period of time, and the like. Therefore, the control device 114 compares the control pattern with the current operation state, whereby it is possible to determine the presence of failure of the refrigerator.

In addition, the storage device 113 includes messages containing the determination results of the presence of failure and the detailed information connected with the determination results. The messages, which mean the determination results themselves, include messages of 'Refrigerating chamber temperature is high', 'It is rumbling', and the like.

When there is an actual failure (such as erroneous operation of the fan), the detailed information includes descriptions on the failure, expediencies for the user to cope with the failure (for example, a message of 'turn off power') and the like. In addition, when there is no actual failure (for example, the compressor or fan is rumbling, rattling or buzzing when the refrigerator starts or stops operating), the detailed information includes descriptions on the phenomenon and/or control methods for the user to deal with the phenomenon (for example, a message of 'set temperature to medium or less' when the temperature in the refrigerating chamber is high). The detailed information includes the information connected with the determination results of the presence of failure.

In addition, the control device 114 controls the entire freezing/refrigerating processes, and further provides a trouble information service to be described bellow in detail.

FIG. 27 is a flowchart of a service of displaying the presence of failure of the avatar refrigerator according to the present invention.

The flowchart of FIG. 27 is limited to a case where the user previously selects the service of displaying the presence of failure of the refrigerator.

First, in step S111, the control device 114 reads a default avatar among the avatar information stored in the storage device 113 and causes the display device 111 to display the avatar.

In addition, in step S112, the control device 114 compares the current operation state with the control pattern stored in the storage device 113 to determine whether or not the refrigerator is out of order. At this time, in a case where the failure actually occurs or where it is not an actual failure but may be misunderstood as a failure, the process goes to step S112. If there is no problem, the process stops.

In step S113, the control device 114 reads the avatar corresponding to the determination result of the presence of failure from the storage device 113 and causes the display device 111 to display the avatar. The avatar displayed at this time may be another avatar corresponding to the determination result which is set after deleting the default avatar displayed on the display device 111, the default avatar having different external appearance and/or motion, or an additional avatar displayed together with the default avatar. Further, at this time, the control device 114 may cause the message showing the determination result of the presence of failure stored in the storage device 113 to be displayed separately from the avatar.

In step S114, the control device 114 determines through the input device 112 whether the user requests the detailed information on the displayed determination result. If there is the request, the process goes to step S115. Otherwise, the process goes to step S116.

In step S115, the control device 114 reads the detailed information on the determination result of the presence of failure stored in the storage device 113 and causes the display device 111 to display the detailed information.

In step S116, the control device 114 determines for a predetermined time whether or not there is user's additional input (such as a command for lowering the refrigerating chamber temperature). If there is an input within the predetermined time, the process goes to step S117. If there is no input within the predetermined time, the process goes to step S118.

In step S117, the control device 114 performs a predetermined control according to the user's input, and causes the process to go to step S116.

In step S118, the control device 114 deletes the avatar, the message, and/or the detailed information currently displayed on the display device 111, reads the default avatar from the storage device 113, causes the display device 111 to display the default avatar, and then stops the process.

A twelfth embodiment of the present invention shows a detailed configuration of the display device applied to the preferred embodiment of the present invention.

FIG. 28 is a block diagram showing the twelfth embodiment of the present invention.

As shown in the figure, in the refrigerator, a main control portion 1210 for controlling generation of cold air and supply of it to the freezing and refrigerating chambers is installed in the refrigerator main body. A sub control portion 1220, which displays the information contained in the information data received from the main control portion 1210 and the avatar character to the user, is installed to a side of the freezing chamber door. Particularly, the sub control portion 1220 is installed to a side of a dispenser portion 126 which is installed on the front surface of the freezing chamber door to easily supply ice and cold water. The main control portion 1210 and the sub control portion 1220 communicate with each other through a power line PL and data lines DL which pass through a hinge 1230 of the freezing chamber door having a hinge hole (not shown).

Specifically, the main control portion 1210 comprises a first power supply portion 1211 for receiving external power (generally, 220V), reducing the external power into power of a predetermined reduced voltage, and supplying the power of the reduced voltage; detecting portions 1212 for detecting the temperatures, humidity, and the like of the freezing and refrigerating chambers; a compressor control portion 1213 for controlling the operation of the compressor; a fan motor control portion 1214 for controlling the fan for circulating the cold air in the freezing and refrigerating chambers; a storing portion 1215 for storing the conditions in the freezing and refrigerating chambers (such as the current temperatures and the service type of the dispenser), the operational information of the freezing and refrigerating chambers (such as the set temperatures of the freezing and refrigerating chambers and the service type of the dispenser), and the like; and a first microprocessor 1216, which is supplied with the power from the first power supply portion 1211, and then controls the entire operation of the freezing and refrigerating chambers by controlling the compressor control portion 1213 and the fan motor control portion 1214 according to the result of the comparison between the detecting results from the detecting portions 1212 and the operational information stored in the storing portion 1215.

The first power supply portion 1211 included in the main control portion 1210 transforms the external power of 220V, for example, into the power of 12V, and supplies the power of 12V to the sub control portion 1220 through the power line PL and the power of a necessary voltage to constitutional elements necessary the power in the main control portion 1210.

Next, the detecting portions 1212, which are installed to the freezing and refrigerating chambers and the like, detect the temperatures, humidity, and the like of the freezing and refrigerating chambers and provide them to the first microprocessor 1216.

As described above, the compressor control portion 1213 and the fan motor control portion 1214 generate and circulate the cold air in the freezing and refrigerating chambers.

In addition, the storing portion 1215 stores the temperatures, humidity, and the like of the freezing and refrigerating chambers, which indicate the conditions of the freezing and refrigerating chambers and at least stores the set temperature, the operation patterns, and the like of the freezing and refrigerating chambers input by the user and transmitted from the sub control portion 1220.

Next, the first microprocessor 1216 controls the compressor control portion 1213 and the fan motor control portion 1214 to cause the cold air to circulate in the freezing and refrigerating chambers, thereby causing the refrigerator to operate according to the operational information stored in the storing portion 1215. At this time, the optimal freezing and refrigerating operations are performed using the information from the detecting portions 1212.

The first microprocessor 1216 communicates with the sub control portion 1220 through the data lines DL, and transmits the information data including the current states and/or operational information of the freezing and refrigerating chambers and also the information data regarding the fact that the freezing chamber door or the like is open through a transmitting portion Tx. In addition, the first microprocessor 1216 receives the information data including the operational information (such as the set temperatures of the freezing and refrigerating chambers and the service type) input by the user through a receiving portion Rx, and stores them in the first storing portion 1215.

Next, the sub control portion 1220 comprises a second power supply portion 1221 for transforming the electric power (for example, 12V), which has been received from the first power supply portion 1211 through the power line PL, into electric power with a variety of voltage amplitudes and providing the converted electric power; a flash memory 1222*a* for storing the avatar character data, the user interface for controlling the freezing and refrigerating chambers, the state and operational information of the freezing and refrigerating chambers, and the like; an SDRAM 1222*b* for temporarily storing predetermined data to process the predetermined data; an input portion 1223 for receiving the user's input; a speaker portion 1224 for generating sound containing a predetermined message; a backlight unit 1225 for generating light using predetermined electric power (for example, 12V) received from the second power supply portion 1221; a liquid crystal display panel (LCD panel) 1226 for displaying the avatar character and the state and/or operational information of the refrigerator with the light generated from the backlight unit 1225; and a second microprocessor 1227 for causing the avatar and the like stored in the second storing portion 1222 to be displayed, receiving the user's input from the input portion 1223, and transmitting the user's input to the main control portion 1210, by controlling the aforementioned constitutional elements.

In addition, the second power supply portion 1221 receives a supply power of 12V to supply the power to the backlight unit 1225. Alternatively, the second power supply portion 1221 transforms the power into the power with a variety of voltage amplitudes (such as 5V, 3.3V, and 1.8V) and then supplies the converted power to the necessary components (such as the microprocessor 1227, the flash memory 1222*a*, the SDRAM 1222*b*, the input portion 1223, and the speaker 1224).

Next, the flash memory 1222*a* stores the avatar data including the avatars (characters) with a variety of forms, the user interface for setting the temperatures of the freezing and refrigerating chambers, the service type of the dispenser, and the like by the user, and the data on the current temperatures of the freezing and refrigerating chambers, the current service type of the dispenser, and the like. In addition, the flash memory 1222*a* stores the sound data and a plurality of messages such as the aforementioned message indicating that the door was opened. Here, the avatar data may include a plurality of the avatars for a variety of user classes, and has a size so that color image qualities of hundreds of thousands or millions of pixels and not black and white or monochrome can be expressed. The flash memory 1222*a* is a storage device that is supplied with the power from the second power supply portion 1221, stores the data lastingly, and makes it possible to partially or entirely delete the data.

In addition, the SDRAM 1222*b* is a storage device for temporarily storing the data (such as the avatar data and the state and operational information of the refrigerator) read from the flash memory 1222*a* by the second microprocessor 1227 to be treated by the second microprocessor 1227. For example, when the treatment is to display the avatar data through the liquid crystal display panel 1226, the second microprocessor 1227 temporarily stores the avatar character data in the SDRAM 1222*b* after reading the avatar character data from the flash memory 1222*a*, and then, transmits the avatar data to the liquid crystal display panel 1226 to be displayed. The SDRAM 1222*b* temporarily stores the data when being supplied with the power from the second power supply portion 1221, while the data is deleted when the power is off.

In addition, in a case where the predetermined data are displayed on the liquid crystal display panel 1226 as described above, particularly in a case where data capacity (i.e., size) is large, it takes long to read the data from the flash memory 1222*a* and thus to transmit the data to the liquid crystal display panel 1226 if the second microprocessor 1227 reads the data from the flash memory 1222*a* and then transmits the read data to the liquid crystal display panel 1226. Thus, there may be a phenomenon that the data are discontinuously displayed on the liquid crystal display panel 1226. To this end, since the SDRAM 1222*b* reads the data at high speed as compared with the flash memory 1222*a* and the time for which the second microprocessor 1227 reads the data from the SDRAM 1222*b* and transmits the data to the liquid crystal display panel 1226 is considerably shortened more than before while the reading speed of the flash memory 1222*a* is constant, it is possible to prevent the data from being discontinuously displayed on the liquid crystal display panel 1226.

Next, as shown in the figure, the input portion 1223 is installed adjacent to the liquid crystal display panel 1226, so that the user can easily input the data.

Also, the speaker portion 1224 generates a sound, since the second microprocessor 1227 is controlled according to the sound data read from the second storing portion 1222.

Next, the backlight unit 1225 and liquid crystal display panel 1226 integrally form a color LCD portion, and thus, display the avatar and the state and operational information of the refrigerator transmitted from the second microprocessor 1227 with a good image quality and more vividly.

In order to read the avatar character and the state and/or operational information of the refrigerator stored in the flash memory 1222*a* and to display them on the liquid crystal display panel 1226, the second microprocessor 1227 reads the data from the flash memory 1222*a*, temporarily stores the data in the SDRAM 1222*b*, and then, transmits the data fast from the SDRAM 1222*b* to the liquid crystal display panel 1226. In addition, the second microprocessor 1227 receives the user's input from the input portion 1223 and transmits it with a predetermined data format from the transmitting portion Tx to the main control portion 1210 through the data lines DL. Further, the second microprocessor 1227 receives the information or the like from the main control portion 1210 through the receiving portion Rx and stores the received information in the flash memory 1222*a*.

At this time, as shown in FIG. 28, the second microprocessor 1227 causes the liquid crystal display panel 1226 to generally display the avatar (such as big and little bears and background) and to display the state and/or operational information of the refrigerator at the left side of the avatar character. Alternatively, the second microprocessor 1227 may divide the screen of the liquid crystal display panel into portions of the avatar character and the state and/or operational information of the refrigerator, and display them separately without overlap.

In addition, the second microprocessor 1227 may selectively display any one of the avatar and the state and/or operational information on the liquid crystal display panel 1226. For example, if the user does neither set the temperatures nor input the service type, the second microprocessor 1227 causes only the avatar to be displayed on the whole liquid crystal display panel 1226. Then, when the input is received through the input portion 1223, the second microprocessor 1227 can cause the state and/or operational information of the refrigerator at that time to be displayed on the liquid crystal display panel 1226.

Furthermore, although it has not been shown, a light emitting diode or a plasma display device may be used instead of the liquid crystal display panel and backlight unit.

Although each of the aforementioned embodiments may be applied independently, it is possible to make an embodiment having some of the characteristics of the respective embodiments. That is, for example, it is possible to make an embodiment having all the characteristics of the fourth and tenth embodiments.

The scope of the present invention is not limited to the embodiments described above but is defined by the claims. It will be apparent that those skilled in the art can make various modifications and changes thereto within the scope of the invention defined by the claims.

INDUSTRIAL APPLICABILITY

According to the present invention so configured, there is an advantage in that the refrigerator display can be made in various ways using the avatars.

The invention claimed is:

1. An avatar refrigerator, comprising:

a refrigerating chamber;

a freezing chamber;

a storage device provided in the refrigerator for storing avatar data;

a display device provided in the refrigerator for displaying the avatar data thereon;

a control device for allowing the avatar data to be displayed on the display device; and an input device for receiving a command or information from the outside, wherein the control device stores separate avatar data for a plurality of avatars to allow an individual avatar to be chosen for each user and stores individual body information according to users, wherein the control device causes at least one avatar to be changed and displayed on the display device according to set information assigned to the avatar, wherein the set information includes at least a state of the refrigerator, wherein the storage device stores a plurality of avatar data different from each other according to growth degrees, growth data numerically represented according to the growth degrees of an avatar and user's health condition information, wherein the avatar refrigerator further includes an avatar breeding device for updating the growth data according to the health condition information, and wherein the input device receives the health condition information from the user and the control device stores the health condition information in the storage device, wherein the avatar refrigerator further includes a measuring device for measuring the user's body fat level and providing the measured level to the control device, and wherein the control device stores the body fat level as the health condition information in the storage device.

2. The avatar refrigerator as claimed in claim 1, wherein the avatar data include at least one of a figure and a motion of an avatar.

3. The avatar refrigerator as claimed in claim 2, wherein the avatar data further includes at least one of voice and letter information.

4. The avatar refrigerator as claimed in claim 1, wherein the control device changes at least one of the avatar data such that the avatar displayed on the display device can be changed.

5. The avatar refrigerator as claimed in claim 1, wherein at least some of the set information is stored or changed by means of the input device.

6. The avatar refrigerator as claimed in claim 1, wherein the control device causes at least one avatar to be displayed on the display device according to the command input through the input device.

7. The avatar refrigerator as claimed in claim 1, wherein the set information causes the avatar to vary according to time.

8. The avatar refrigerator as claimed in claim 1, further comprising a date and time counting device for calculating a current date and time, wherein the control device changes the avatar displayed on the display device according to the current date and time obtained from the date and time counting device.

9. The avatar refrigerator as claimed in claim 1, wherein the refrigerator state includes at least one of a temperature in a chamber, a door opening and closing state, a horizontal state of the refrigerator, and an operating state of a compressor.

10. The avatar refrigerator as claimed in claim 9, further comprising a horizontal detecting portion for detecting the horizontal state of the refrigerator.

11. The avatar refrigerator as claimed in claim 10, wherein the control device obtains a gradient from the horizontal detecting portion and causes the gradient to be displayed on the display device.

12. The avatar refrigerator as claimed in claim 1, wherein the avatar set information includes information on a health condition, and the control device causes the avatar having the set information corresponding to the information on the health condition of a user to be displayed on the display device.

13. The avatar refrigerator as claimed in claim 12, wherein the user's health condition information is stored or changed by means of the input device.

14. The avatar refrigerator as claimed in claim 13, wherein the refrigerator is connected to a health measuring device for measuring the user's health condition, and the control device obtains the health condition information from a value measured from the health measuring device and stores the obtained health condition information into the storage device.

15. The avatar refrigerator as claimed in claim 14, wherein the control device causes an abnormal region of a user's body to be displayed at a corresponding area on the avatar according to the health condition information.

16. The avatar refrigerator as claimed in claim 15, wherein the portion of the avatar corresponding to the abnormal region of the user's body is changed in color or shape or flickers.

17. The avatar refrigerator as claimed in claim 12, wherein the storage device stores standard health information, and the control device compares the user's health condition information with the standard health information to determine the user's health condition.

18. The avatar refrigerator as claimed in claim 17, wherein the control device causes the user's health condition to be displayed on the display device in the form of letters when receiving the user's health condition from the input device.

19. The avatar refrigerator as claimed in claim 17, wherein the storage device further includes predetermined treatment information, and the control device causes the treatment information corresponding to the user's health condition to be displayed on the display device.

20. The avatar refrigerator as claimed in claim 1, wherein the input device includes at least one of an information input portion, a blood pressure measuring portion and a blood sugar measuring portion, and the control device causes the information input from the input device to be stored.

21. The avatar refrigerator as claimed in claim 20, wherein the health condition information input through the information input portion includes at least one of blood pressure, a blood sugar, the body information, percent body fat.

22. The avatar refrigerator as claimed in claim 21, wherein the input device includes a mode switching portion for switching a mode to a management mode in which the input information is shown, and a data input portion for allowing the individual avatar to be chosen among avatars displayed on the display device in the management mode switched by the mode switching portion and the individual health condition information to be input into the chosen avatar.

23. The avatar refrigerator as claimed in claim 22, wherein the control device includes a data storing portion for accumulatively storing the individual health condition information input through the input device according to dates in the chosen individual avatar, and a data processing portion for causing a change in the health condition information stored in the data storing portion to be displayed on the display device.

24. The avatar refrigerator as claimed in claim 23, wherein the data processing portion causes only the change in the health condition information for the last few days to be displayed on the display device.

25. The avatar refrigerator as claimed in claim 24, wherein the data processing portion determines test time based on the change in the data according to dates and causes the determined test time to be displayed on the display device.

26. The avatar refrigerator as claimed in claim 22, wherein the control device includes a data processing portion for comparing the individual health condition information input from the input device with the preset standard health condition information to manage a health condition or prescription, and a data storing portion for accumulatively storing the individual health condition information input from the input device and the individual health condition or prescription managed in the data processing portion together with a measuring date for each individual avatar.

27. The avatar refrigerator as claimed in claim 26, wherein the data processing portion causes the individual health condition information accumulatively stored in the data storing portion and the health condition change or prescription to be displayed on the display device.

28. The avatar refrigerator as claimed in claim 21, wherein the blood sugar measuring portion includes a noninvasive blood sugar sensor capable of measuring a blood sugar level in a state where a body region is brought into contact with the sensor.

29. The avatar refrigerator as claimed in claim 21, wherein the body information includes at least one of sex, name, age, weight and stature.

30. The avatar refrigerator as claimed in claim 29, wherein the refrigerator provides recommendable exercise suitable to the input body information and corresponding calorie consumption, and the recommendable exercise and corresponding calorie consumption provided to the control device are displayed on the display device using the avatar.

31. The avatar refrigerator as claimed in claim 1, further comprising an image pickup device for taking a motion image of a user.

32. The avatar refrigerator as claimed in claim 1, wherein the health condition information includes at least one of a user's body fat level and a calorie of food ingested by the user.

33. The avatar refrigerator as claimed in claim 1, wherein the input device receives a growth period of time of the avatar, and the control device causes the avatar to grow for the growth period of time.

34. The avatar refrigerator as claimed in claim 1, wherein the storage device stores calorie information of food, and the control device causes an image of the food to be displayed on the display device and receives information of the food chosen through the input device by the user to calculate the calorie of food ingested by the user.

35. The avatar refrigerator as claimed in claim 1, wherein the storage device stores data on a breeding state where the avatar is bred, the display device displays the breeding state; the avatar breeding device updates the growth data according to a breeding command on the basis of the health condition information and the breeding state, and the control device receives the breeding command from the input device to transmit the breeding state data, the growth data and the health condition information to the avatar breeding device and to receives the updated growth data from the avatar breeding device.

36. The avatar refrigerator as claimed in claim 1, wherein the control device determines whether the refrigerator is out of order or operates erroneously, and causes an avatar selected in accordance with the determination or a message indicating a determination result to be displayed on the display device.

37. The avatar refrigerator as claimed in claim 36, further comprising an input device for allowing the user to input a request of detailed information on the determination result, wherein the storage device further stores the detailed information corresponding to the determination result and the control device causes the detailed information to be displayed on the display device at the request of the input device.

38. The avatar refrigerator as claimed in claim 36, wherein the storage device stores a control pattern of the refrigerator and the control device compares a current operating state with the control pattern to determine whether the refrigerator is out of order.

39. The avatar refrigerator as claimed in claim 1, wherein the display device comprises:

a power supply portion for receiving supplied power with predetermined voltage amplitude from the control device to generate a plurality of electric power;

a display portion for receiving the supplied power or electric power to cause the avatar data and state and operating information of the refrigerator to be displayed thereon;

a first storing portion for storing the avatar data and the state and operating information of the refrigerator;

a second storing portion for temporarily storing the avatar data and the state and operating information of the refrigerator to transmit the data and information to the display portion; and a microprocessor supplied with the electric power for receiving the information data including the state and operating information of the refrigerator from the control device, storing the received information data in the first storing portion, reading the avatar data and the state and operating information of the refrigerator from the first storing portion to transmit and temporarily storing the data and information to and in the second storing portion, and reading the avatar data and the state and operating information of the refrigerator from the second storing portion to transmit the data and information to the display portion on which the data and information can be displayed.

40. The avatar refrigerator as claimed in claim 39, wherein the display portion includes any one of a liquid crystal display device, a light emitting diode and a plasma display device.

41. The avatar refrigerator as claimed in claim 39, wherein the first storing portion is a flash memory and the second storing portion is an SDRAM.

42. The avatar refrigerator as claimed in claim 39, further comprising an input device for receiving an input command from the user, wherein the microprocessor transmits the information data including the input command to the control device.

43. The avatar refrigerator as claimed in claim 42, wherein the microprocessor causes at least one of the avatar character and the state and operating information of the refrigerator to be selectively displayed.

44. The avatar refrigerator as claimed in claim 43, wherein the microprocessor reads the information data to cause the data to be displayed on the avatar when receiving the information data.

45. The avatar refrigerator as claimed in claim 39, wherein the display device further comprises a speaker portion for generating a sound.

46. The avatar refrigerator as claimed in claim 1, wherein the display device further includes a speaker portion for generating a sound.

* * * * *